US010906318B2

(12) United States Patent
Ogawa

(10) Patent No.: US 10,906,318 B2
(45) Date of Patent: Feb. 2, 2021

(54) LIQUID JETTING APPARATUS

(71) Applicant: BROTHER KOGYO KABUSHIKI KAISHA, Nagoya (JP)

(72) Inventor: Mikio Ogawa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/185,206

(22) Filed: Nov. 9, 2018

(65) Prior Publication Data

US 2019/0143698 A1 May 16, 2019

Related U.S. Application Data

(63) Continuation of application No. 15/349,082, filed on Nov. 11, 2016, now Pat. No. 10,124,592.

(30) Foreign Application Priority Data

Nov. 12, 2015 (JP) ..... 2015-221816

(51) Int. Cl.
*B41J 2/165* (2006.01)

(52) U.S. Cl.
CPC ..... *B41J 2/16511* (2013.01); *B41J 2/16508* (2013.01); *B41J 2/16523* (2013.01);
(Continued)

(58) Field of Classification Search
CPC ..... B41J 2/16508; B41J 2/16511; B41J 2/16505; B41J 2/16523; B41J 2/16517;
(Continued)

(56) References Cited

U.S. PATENT DOCUMENTS

2004/0263559 A1 12/2004 Yoshida et al.
2005/0030335 A1 2/2005 Takahashi et al.
(Continued)

FOREIGN PATENT DOCUMENTS

JP 2003-094673 A 4/2003
JP 2006175666 A 7/2006
(Continued)

OTHER PUBLICATIONS

United States Notice of Allowance dated Jul. 11, 2018 received in related U.S. Appl. No. 15/349,082.
(Continued)

*Primary Examiner* — Jannelle M Lebron
(74) *Attorney, Agent, or Firm* — Scully, Scott, Murphy & Presser, P.C.

(57) ABSTRACT

A liquid jetting apparatus includes: a head unit including nozzles; a cap which covers the nozzles in a state of being in contact with the head unit at a capping position; and a cap movement device including a cam having a slide surface and a cam follower which is slid on the slide surface. One of the cam and the cam follower is provided integrally with the cap, and the other of the cam and the cam follower is moved in a slide direction. The slide surface includes a first inclined surface inclined by a first angle relative to the slide direction and a second inclined surface inclined by a second angle greater than the first angle relative to the slide direction.

15 Claims, 18 Drawing Sheets

(52) U.S. Cl.
CPC .. *B41J 2/16532* (2013.01); *B41J 2002/16514* (2013.01); *B41J 2002/16573* (2013.01)

(58) Field of Classification Search
CPC ..... B41J 2002/16514; B41J 2/1652; B41J 2/16532; B41J 2002/16594; B41J 2002/16573; B41J 2/165; B41J 2/1714
See application file for complete search history.

(56) References Cited

U.S. PATENT DOCUMENTS

| | | | | |
|---|---|---|---|---|
| 2006/0077223 | A1 | 4/2006 | Kambe | |
| 2007/0165062 | A1 | 7/2007 | Usui et al. | |
| 2008/0007590 | A1 | 1/2008 | Lee | |
| 2008/0158283 | A1 | 7/2008 | Tsai et al. | |
| 2013/0083121 | A1* | 4/2013 | Higashikawa | B41J 2/1714 347/30 |
| 2015/0224774 | A1* | 8/2015 | Nakazawa | B41J 2/16526 347/30 |

FOREIGN PATENT DOCUMENTS

| | | | |
|---|---|---|---|
| JP | 5056465 | B2 | 10/2012 |
| JP | 2014100892 | A | 6/2014 |
| WO | 2003035402 | A1 | 2/2005 |

OTHER PUBLICATIONS

United States Office Action dated Oct. 6, 2017 received in related U.S. Appl. No. 15/349,082.
Notice of Reasons for Rejection dated Sep. 3, 2019 received from the Japanese Patent Office in related application 2015-221816 together with English language translation.

* cited by examiner 72
77
79a
77d
68c
76f
76e
76a1
76a
76
76c
76d
76b
CONVEYANCE DIRECTION

LEFT ⟷ RIGHT
SCANNING DIRECTION

LEFT ⟷ RIGHT
SCANNING DIRECTION

LIQUID JETTING APPARATUS

CROSS REFERENCE TO RELATED APPLICATION

This application is a continuation of U.S. application Ser. No. 15/349,082, filed Nov. 11, 2016, which claims priority from Japanese Patent Application No. 2015-221816 filed on Nov. 12, 2015, the disclosure of which is incorporated herein by reference in its entirety.

BACKGROUND

Field of the Invention

The present invention relates to a liquid jetting apparatus configured to jet liquid from nozzles.

Description of the Related Art

As an exemplary liquid jetting apparatus jetting liquid from nozzles, Japanese Patent No. 5056465 describes a printing apparatus which jets ink from nozzles to perform printing. The printing apparatus described in Japanese Patent No. 5056465 includes a head cap mechanism. The head cap mechanism includes a slider, a cap holder, a head cap, and a cam mechanism. The slider is provided in a housing to be slidable in a carriage movement direction. The cap holder is slidably provided in the slider to be closer to or away from a printing head. The head cap is fixed to the cap holder. The cam mechanism changes the distance between the cap holder and the printing head depending on the position of the slider. The cam mechanism has a cam follower, first to third cam surfaces, and first and second inclined cam surfaces. The first to third cam surfaces and the first and second inclined cam surfaces make contact with the cam follower. The first cam surface is closest from the printing head, the second cam surface is second closest from the printing head, and the third cam surface is farthest from the printing head. The first inclined surface is disposed between the first cam surface and the second cam surface. The second inclined surface is disposed between the second cam surface and the third cam surface.

The cam follower is positioned on the first cam surface in a state where the head cap is in close contact with a nozzle forming surface. The head cap is disposed to have an inspection space between itself and the nozzle forming surface in a state where the cam follower is positioned on the second cam surface. The head cap is disposed farther away from the nozzle forming surface than the case in which the cam follower is positioned on the second cam surface, in a state where the cam follower is positioned on the third cam surface. The cam follower moves between the first cam surface and the second cam surface along the first inclined cam surface, and moves between the second cam surface and the third cam surface along the second inclined cam surface.

SUMMARY

Regarding Japanese Patent No. 5056465, movement speed of the head cap in a direction perpendicular to the nozzle forming surface increases as the inclined angles of the first and second inclined cam surfaces relative to the carriage movement direction are greater. This reduces the time required for movement of the head cap. In this case, the movement speed of the head cap in the direction perpendicular to the nozzle forming surface increases also when the head cap makes contact with and separates from the nozzle forming surface. This may cause an ink spill from the nozzle cap and the destruction of ink meniscuses in the nozzles, when the nozzle cap separates from the nozzle forming surface.

An object of the present teaching is to provide a liquid jetting apparatus capable of reducing the time required for cap movement as much as possible, while reducing the cap movement speed in a direction perpendicular to a liquid jetting surface when a cap makes contact with and separates from the liquid jetting surface.

According to a first aspect of the present teaching, there is provided a liquid jetting apparatus, including:

- a head unit including nozzles;
- a cap configured to cover the nozzles in a state of being in contact with the head unit at a capping position; and
- a cap movement device including a cam having a slide surface and a cam follower configured to be slid on the slide surface,
- wherein one of the cam and the cam follower is provided integrally with the cap, and the other of the cam and the cam follower is configured to be moved in a slide direction by power transmitted from a drive source,
- the slide surface includes:
  - a first inclined surface extending while being inclined by a predetermined first angle relative to the slide direction and on which the cam follower is positioned under a condition that the cap is positioned between the capping position and an intermediate position at which the cap is apart from the head unit; and
  - a second inclined surface extending while being inclined by a second angle greater than the first angle relative to the slide direction and on which the cam follower is positioned under a condition that the cap is positioned between the intermediate position and an uncapping position at which the cap is apart from the head unit farther than the intermediate position.

According to a second aspect of the present teaching, there is provided a liquid jetting apparatus, including:

- a head unit including nozzles;
- a cap configured to cover the nozzles in a state of being in contact with the head unit;
- a suction pump fluidly connected to the cap;
- a cap movement device configured to move the cap, between a capping position at which the cap is in contact with the head unit and an uncapping position at which the cap is completely separated from the head unit, via an intermediate position between the capping position and the uncapping position; and
- a controller configured to control the cap movement device and the suction pump,
- wherein the controller is configured to perform:
  - a suction purge process in which liquid in the head unit is discharged from the nozzles to the cap by driving the suction pump, after the cap is moved to the capping position;
  - a first movement process in which the cap is moved from the capping position to the intermediate position at a first movement speed, after the suction purge process;
  - an idle suction process in which the liquid accumulated in the cap by the suction purge process is discharged by driving the suction pump, after the cap is moved to the intermediate position by the first movement process; and a second movement process in which the cap is moved from the intermediate position to the uncapping position at a second movement speed faster than the first movement speed, after the idle suction process.

According to a third aspect of the present teaching, there is provided a liquid jetting apparatus, including:

a head unit including nozzles;

a cap configured to cover the nozzles in a state of being in contact with the head unit;

a cap movement device configured to move the cap, between a capping position at which the cap is in contact with the head unit and an uncapping position at which the cap is completely separated from the head unit, via an intermediate position in which the cap is positioned between the capping position and the uncapping position while being completely separated from the head unit; and a controller configured to control the cap movement device, wherein the controller is configured to move the cap at a first movement speed in a range from the capping position to the intermediate position, and move the cap at a second movement speed faster than the first movement speed in a range from the intermediate position to the uncapping position.

In the present teaching, the second angle is greater than the first angle. This allows the time required for movement of the cap between the capping position and the uncapping position to be shorter than a case in which both of the first and second inclined surfaces are inclined by the first angle relative to the slide direction. Further, the cap movement speed when the cap makes contact with and separates from the liquid jetting surface is allowed to be slower than a case in which both of the first and second inclined surfaces are inclined by the second angle relative to the slide direction. Namely, the present teaching achieves, in a well-balanced manner, reduction of the time required for movement of the cap between the capping position and the uncapping position and reduction of the cap movement speed when the cap makes contact with and separates from the liquid jetting surface, unlike the case in which both of the first and second inclined surfaces are inclined by the first angle relative to the slide direction and the case in which both of the first and second inclined surfaces are inclined by the second angle relative to the slide direction.

In the present teaching, the wording "provided integrally with the cap" means that an object is directly provided in the cap, that the object is provided in a member, such as a support member as described later, which moves integrally with the cap, or the like. Namely, the wording means that the object is provided to be moved integrally with the cap.

DESCRIPTION OF THE EMBODIMENTS

Preferred embodiments of the present teaching will be described below.

<Overall Configuration of Printer>

Figure 1:
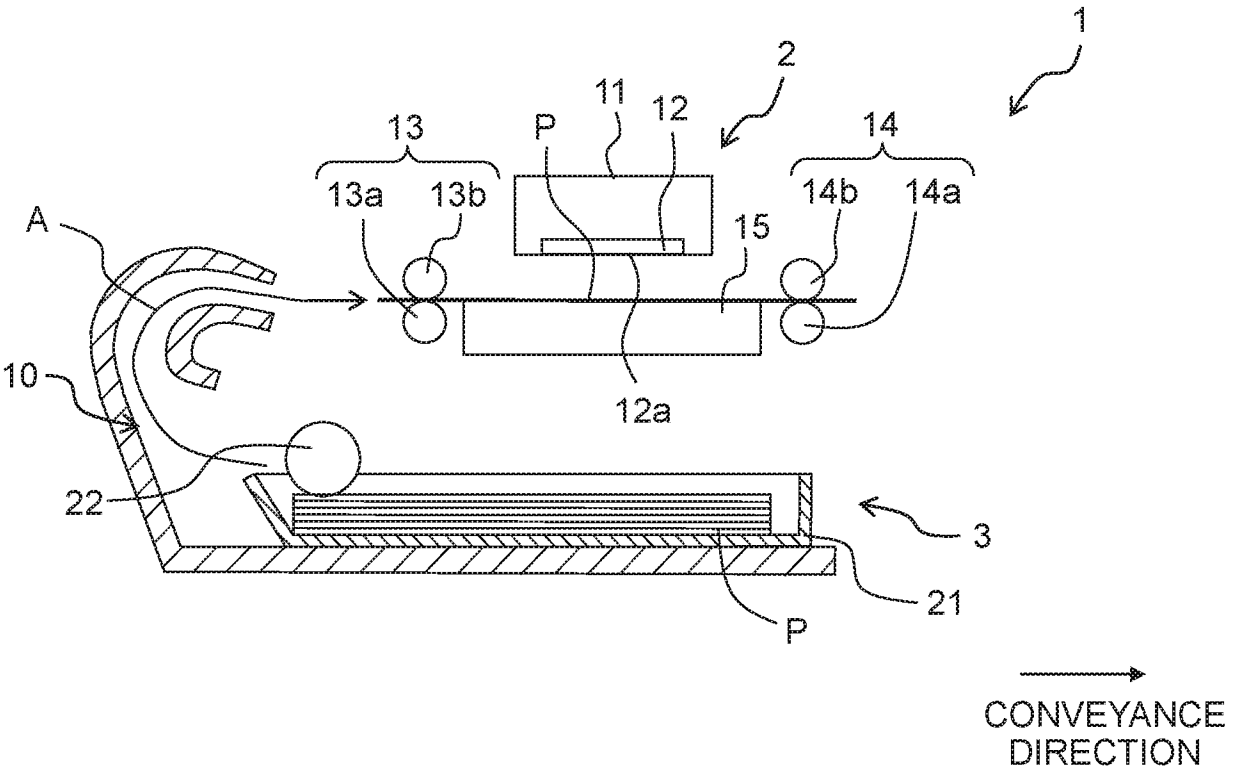
FIG. 1 is a schematic side view of a printer according to an embodiment of the present teaching.
Figure 2:
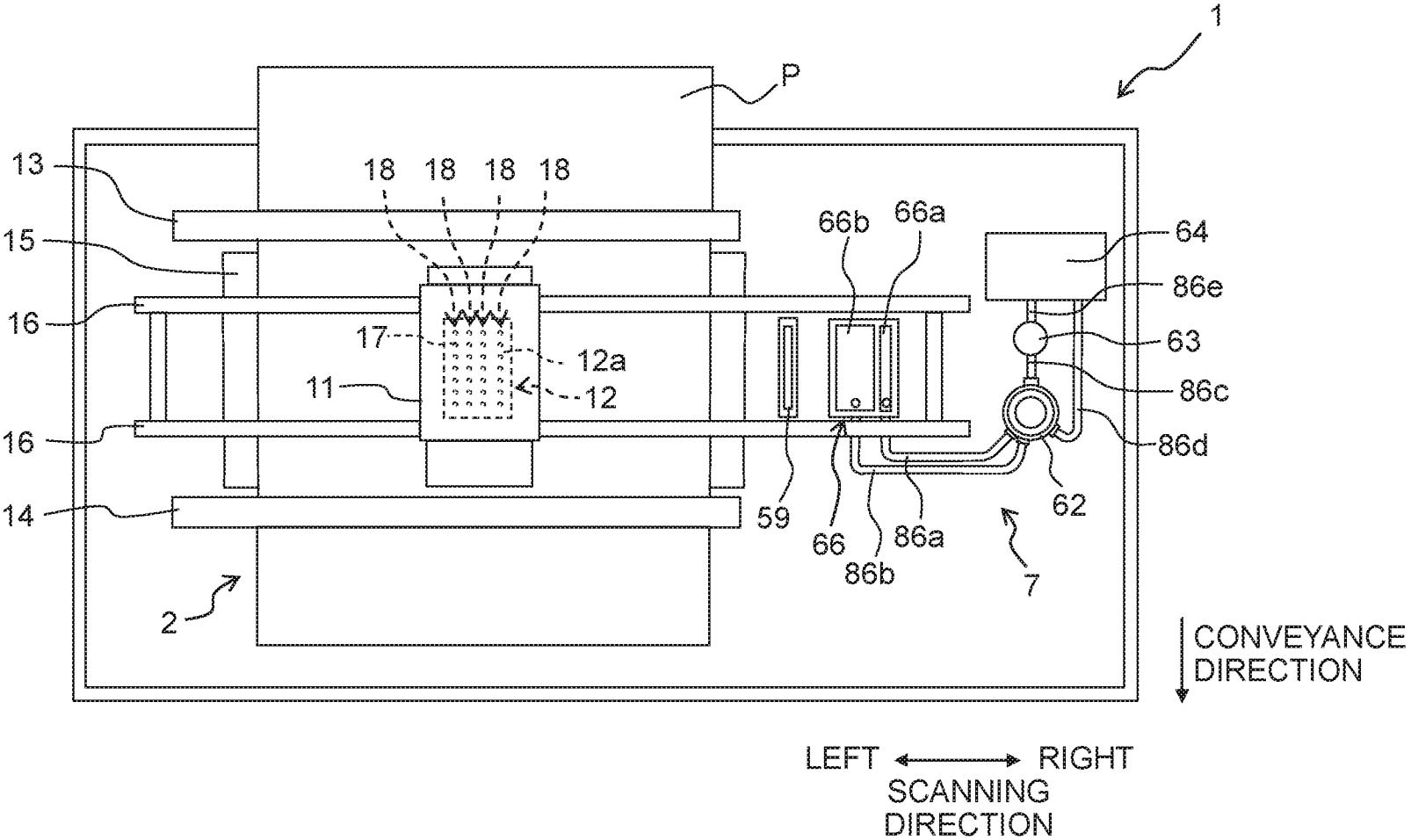
FIG. 2 is a schematic plan view of a printing unit and a maintenance unit.

As depicted in FIGS. 1 and 2, a printer 1 of this embodiment (a "liquid jetting apparatus" of the present teaching) includes, for example, a printing unit 2, a feed part 3, and a maintenance unit 7.

<Printing Unit>

The printing unit 2 includes, for example, a carriage 11, an ink-jet head 12 (a "liquid jetting head" of the present teaching), conveyance rollers 13, 14, and a platen 15. The carriage 11 is movably supported in a scanning direction by two guide rails 16 extending in the scanning direction. The carriage 11, which is connected to a carriage motor 156 (see FIG. 14) via an unillustrated belt and pulley, is driven by the carriage motor 156 so as to reciprocate in the scanning direction. In the following, the right and the left in the scanning direction are defined as indicated in FIG. 2.

The ink-jet head 12, which is carried on the carriage 11, jets an ink from nozzles 17 formed in an ink jetting surface 12*a* (a "liquid jetting surface" of the present teaching) which is a lower surface of the ink-jet head 12. The nozzles 17, which are disposed to align in a conveyance direction orthogonal to the scanning direction, form nozzle rows 18. The ink-jet head 12 includes four nozzle rows 18 arranged in the scanning direction. Inks of black, yellow, cyan, and magenta are jetted from the nozzles 17 of the four nozzle rows 18 respectively, in the order of the nozzle rows 18 from the right side in the scanning direction. The carriage 11 and the ink-jet head 12 each correspond to a "head unit" of the present teaching.

Figure 12A:
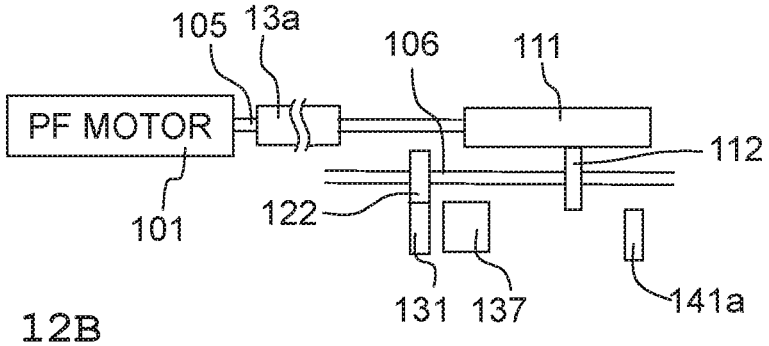
FIGS. 12A to 12C are diagrams each illustrating connection relations between a PF motor and a drive roller and a PF input gear and a PF switch gear, FIG. 12A depicting a state in which an ASF switch gear engages with a feed gear, FIG. 12B depicting a state in which the PF switch gear fails to engage with a pump drive gear and the ASF switch gear engages with a selective drive gear, FIG. 12C depicting a state in which the PF switch gear engages with the pump drive gear and the ASF switch gear engages with the selective drive gear.
Figure 12B:
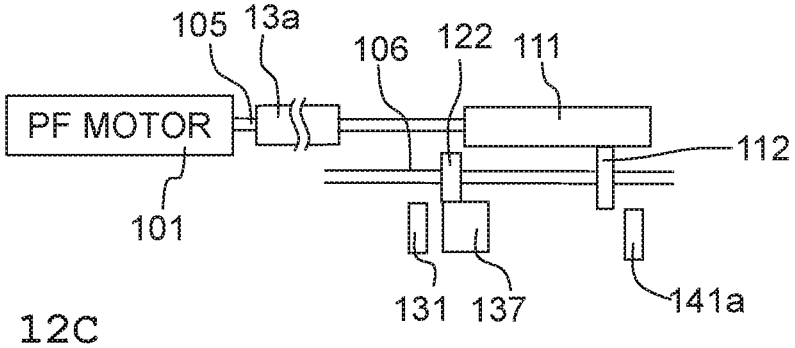

The conveyance rollers 13 are disposed upstream of the carriage 11 in the conveyance direction, which is parallel to the ink jetting surface 12*a* and orthogonal to the scanning direction. The conveyance rollers 13 include a drive roller 13*a* and a driven roller 13*b* disposed on the upper side of the drive roller 13*a*. As will be described later, the drive roller 13*a* is connected to a PF motor 101 (see FIG. 12). Driving the PF motor 101 reversely (counterclockwise) transmits power from the PF motor 101 to the drive roller 13*a*, thereby rotating the drive roller 13*a* in a clockwise direction in FIG. 1. This conveys a recording sheet P in the conveyance direction in a state where the recording sheet P is nipped by the drive roller 13*a* and the driven roller 13*b*. Driving the PF motor 101 normally (clockwise) rotates the drive roller 13*a* in a counterclockwise direction in FIG. 1.

The conveyance rollers 14 are disposed downstream of the carriage 11 in the conveyance direction. The conveyance rollers 14 include a drive roller 14*a* and a driven roller 14*b* disposed on the upper side of the drive roller 14*a*. The drive roller 14*a* is connected to the drive roller 13*a* via unillustrated gears. Thus, when power is transmitted from the PF motor 101 to the drive roller 13*a*, drive force is transmitted also to the drive roller 14*a* to rotate the drive roller 14*a*. In this situation, the drive rollers 13*a*, 14*a* have the same rotation direction. Accordingly, rotating the PF motor 101 reversely (counterclockwise) conveys the recording sheet P in the conveyance direction in a state where the recording sheet P is nipped by the drive roller 14*a* and the driven roller 14*b*.

The platen 15 is disposed between the conveyance rollers 13, 14 in the conveyance direction to face the ink jetting surface 12*a*. The platen 15 supports, from below, the recording sheet P conveyed by the conveyance rollers 13, 14.

<Feed Part>

The feed part 3 is disposed below the platen 15. The feed part 3 includes a sheet cassette 21 and a feed roller 22. The sheet cassette 21 accommodates recording sheets P stacked vertically. As will be described later, the feed roller 22 is connectable to an ASF motor 102 via gears including a feed gear 131 (see FIG. 12, illustration of the gears is omitted except for the feed gear 131). Rotating the ASF motor 102 normally in a state where the feed roller 22 is connected to the ASF motor 102 transmits power from the ASF motor 102 to the feed roller 22 to rotate the feed roller 22 in the clockwise direction in FIG. 1. This rotation conveys the recording sheet P accommodated in the feed cassette 21 toward the upstream side in the conveyance direction. A supply route 10 is provided upstream of the feed cassette 21 in the conveyance direction to guide the recording sheet P fed from the downstream side in the conveyance direction to a position upstream of the conveyance rollers 13 in the conveyance direction. The recording sheet P fed by the feed roller 22 is conveyed upstream of the conveyance rollers 13 in the conveyance direction along the supply route 10 and then supplied to the printing unit 2, as indicated by an arrow A1 in FIG. 1.

<Maintenance Unit>

Subsequently, the maintenance unit 7 will be explained. As depicted in FIGS. 2 to 11, the maintenance unit 7 includes a wiper 59, a cap unit 61, a switch valve 62, a suction pump 63, and a waste liquid tank 64.

<Wiper>

The wiper 59 is disposed on the right of the platen 15. The wiper 59 is moved up and down by a wiper lifting unit 157 (see FIG. 14). The upper end of the wiper 59 is positioned above the ink jetting surface 12*a* in a state where the wiper 59 is raised by the wiper lifting unit 157. When the carriage 11 is moved in a state where the wiper 59 is raised, the wiper 59 makes contact with the ink jetting surface 12*a*. Meanwhile, the upper end of the wiper 59 is positioned below the ink jetting surface 12 in a state where the wiper 59 is lowered by the wiper lifting unit 157. When the carriage 11 is moved in a state where the wiper 59 is lowered, the wiper 59 does not make contact with the ink jetting surface 12*a*.

<Cap Unit>

The cap unit 61 includes a nozzle cap 66, a cap holder 67, a support member 68, and a spring 69 (an "elastic member" of the present teaching).

The nozzle cap 66, which is made of a rubber material, is disposed on the right of the wiper 59 in the scanning direction. The nozzle cap 66 includes two caps 66*a* and 66*b* formed integrally. The caps 66*a* and 66*b* are disposed adjacent to each other such that the cap 66*a* is on the right side of the cap 66*b* in the scanning direction. When the carriage 11 moves to a position where the ink jetting surface 12*a* faces the nozzle cap 66, the rightmost nozzle row 18 overlaps with the cap 66*a* and three nozzle rows 18 on the left of the rightmost nozzle row 18 overlap with the cap 66*b*. The cap unit 61 is movable up and down ("movable in a cap movement direction" of the present teaching) as described later. When a cap lifting mechanism 71 described below moves the cap unit 61 upward in a state where the ink jetting surface 12*a* faces the nozzle cap 66, the nozzle cap 66 makes contact with the ink jetting surface 12*a* so that the cap 66*a* covers the rightmost nozzle row 18 and the cap 66*b* covers the three nozzle rows 18 on the left side of the rightmost nozzle row 18.

The cap holder 67, which supports the nozzle cap 66 from below, increases the rigidity of the nozzle cap 66. The support member 68, which is disposed below the cap holder 67, supports the cap holder 67 from below. A guide member 58 (a "movement support part" of the present teaching) is disposed to surround the support member 68. Protruding parts 68*a* extending in an up-down direction are formed at both end surfaces of the support member 68 in the conveyance direction. The guide member 58 has guide grooves 58*a* extending in the up-down direction and engaging with the protruding parts 68*a*. The support member 68 can move up and down by moving the protruding parts 68*a* of the support member 68 along the guide grooves 58*a*. Moving the support member 68 up and down moves the cap unit 61 with the support member 68 and the nozzle cap 66 up and down. The guide member 58 is fixed to an unillustrated frame provided in a body of the printer 1.

Protruding parts 68*b* protruding downward are provided in the vicinities of both ends of the lower surface of the support member 68 in the scanning direction. Cam followers 68*c* extending in the scanning direction are formed in outer side surfaces of the protruding parts 68*b* in the scanning direction, respectively. The nozzle cap 66 and the support member 68 with the cam followers 68*c* integrally move up and down when the cap unit 61 moves up and down. Namely, the cam followers 68*c* are formed integrally with the nozzle cap 66. The spring 69, which is disposed between the cap holder 67 and the support member 68, urges the cap holder 67 upward.

<Cap Lifting Mechanism>

Figure 3A:
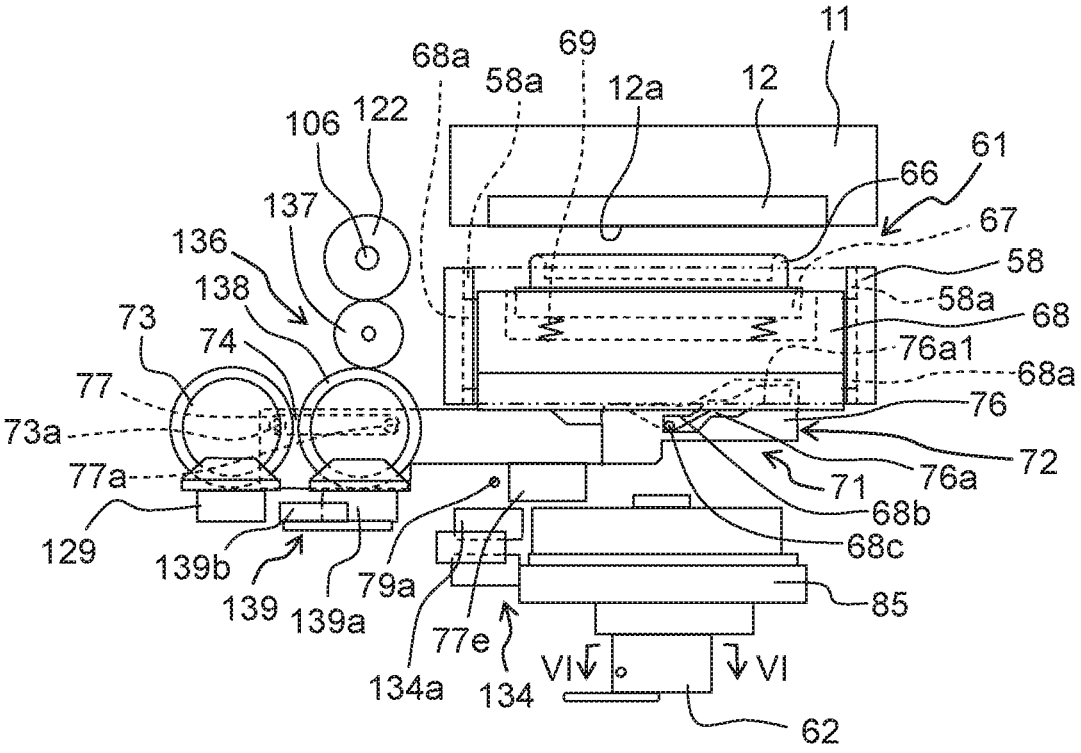
FIG. 3A depicts an arrangement of a cap lifting mechanism, a switch valve, and gears to be connected to them as viewed from the right in a scanning direction.
Figure 3B:
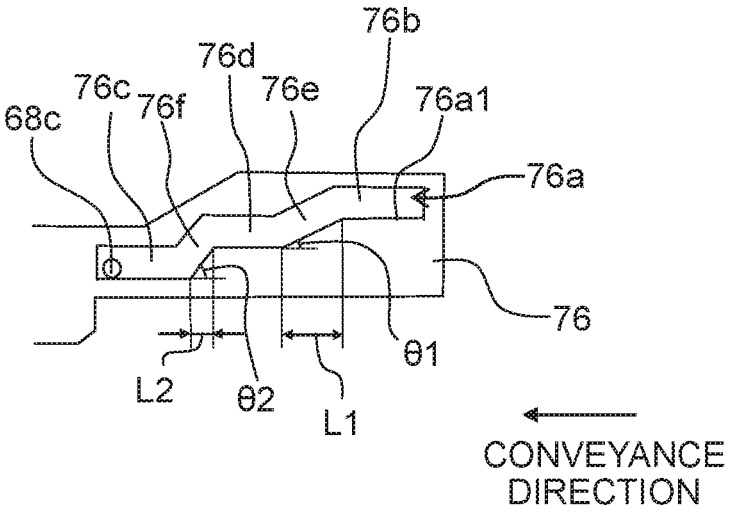
FIG. 3B is an enlarged view depicting surroundings of a groove of a slide cam of FIG. 3A.
Figure 4A:
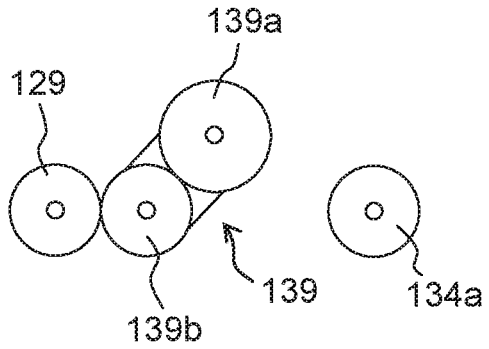
FIGS. 4A and 4B each depict positional relations between a planet gear mechanism and a bevel gear and a valve drive gear as viewed from above, FIG. 4A depicting a state in which a planet gear engages with the bevel gear, FIG. 4B depicting a state in which the planet gear engages with the valve drive gear.
Figure 4B:
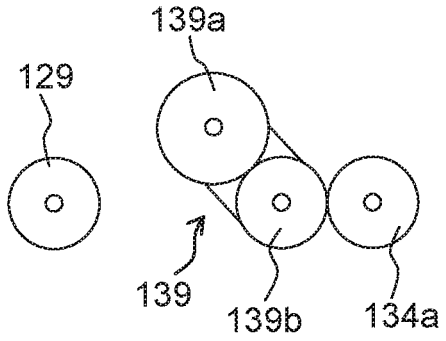
Figure 4B:
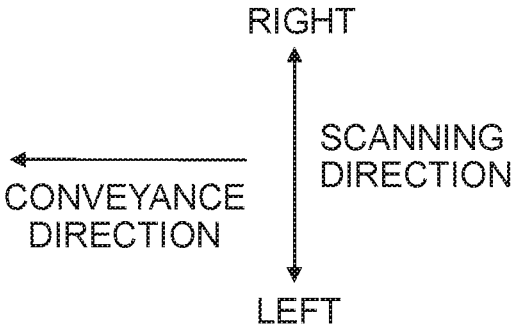
Figure 5:
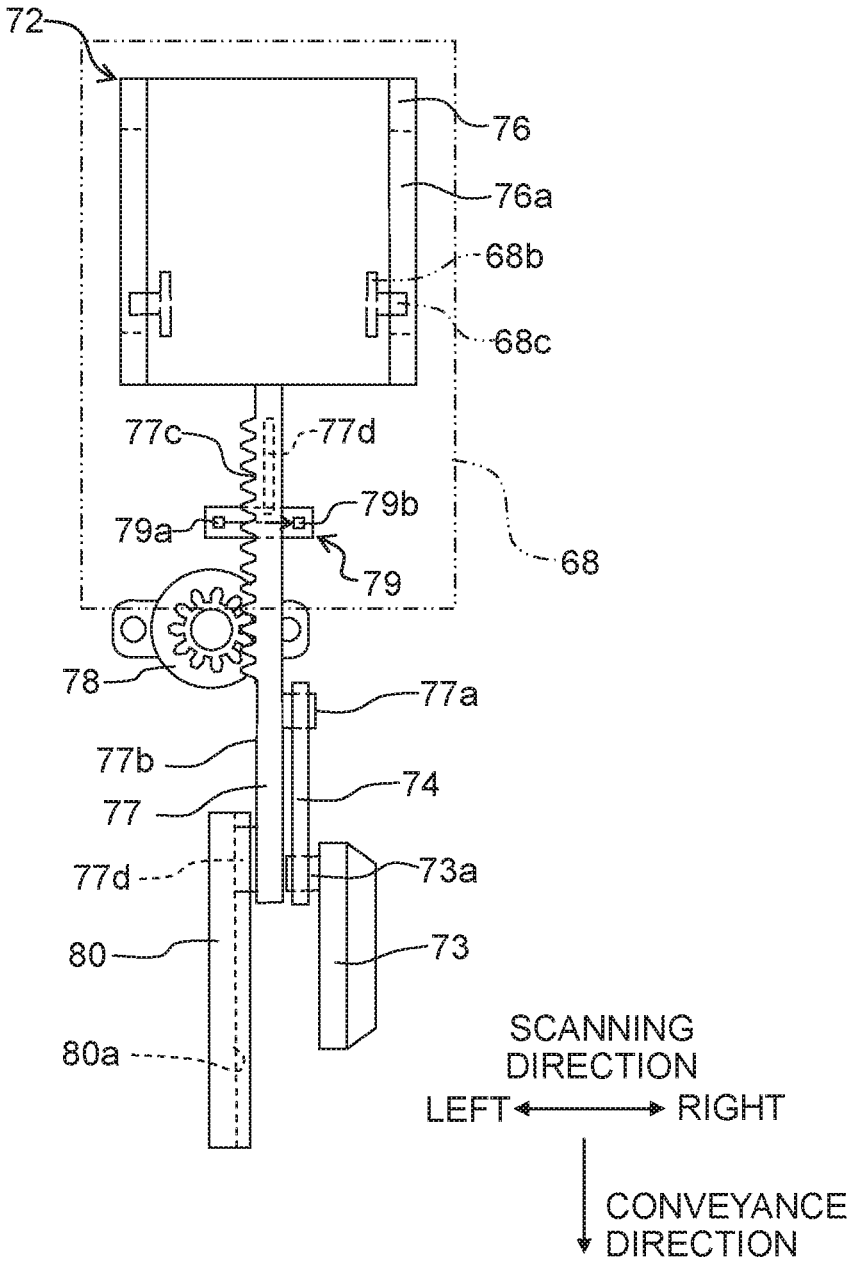
FIG. 5 is a plan view of the slide cam.

The cap lifting mechanism 71 moving the cap unit 61 up and down will be explained. As depicted in FIGS. 3 to 5, the cap lifting mechanism 71 includes a slide cam 72 (a "cam" of the present teaching), a crank gear 73, and an arm 74. In this embodiment, a combination of the cap lifting mechanism 71 and the support member 68 corresponds to a "cap movement device" of the present teaching.

The slide cam 72 includes two parts 76 and 77. The part 76 is disposed below the support member 68 to extend in the conveyance direction. Grooves 76*a* are formed at both ends of the part 76 in the scanning direction. The cam followers 68*c* of the support member 68 are inserted into the grooves 76*a*. As depicted in FIG. 3B, each groove 76*a* includes three parallel parts 76*b*, 76*c*, and 76*d* and two inclined parts 76*e*, 76*f*. For easy understanding of the structure of the groove 76*a*, the length of the slide cam 72 in the conveyance direction in FIG. 3B is longer than that of FIG. 3A.

The parallel part 76*b* is disposed at an upstream end of the part 76 in the conveyance direction and extends parallel to the conveyance direction. The parallel part 76*c* is disposed below the parallel part 76*b*, disposed downstream of the parallel part 76*b* in the conveyance direction, and extends parallel to the conveyance direction. The parallel part 76*d* is disposed between the parallel parts 76*b*, 76*c* in the conveyance direction and the up-down direction and extends parallel to the conveyance direction. The inclined part 76*e* is disposed between the parallel parts 76*b* and 76*d* in the conveyance direction, extends in the conveyance direction while being inclined by an inclined angle θ1 (for example, approximately 24°, a "first angle" of the present teaching), and connects the parallel parts 76*b* and 76*d*. The inclined part 76*f* is disposed between the parallel parts 76*c* and 76*d* in the conveyance direction, extends in the conveyance direction while being inclined by an inclined angle θ2 (for example, approximately 25°, a "second angle" of the present teaching) greater than the inclined angle θ1, and connects the parallel parts 76*c* and 76*d*. A length L2 of the inclined part 76*f* in the conveyance direction is shorter than a length L1 of the inclined part 76*e* in the conveyance direction. In this embodiment, a lower surface of each groove 76*a* is a slide surface 76*a*1 on which the cam follower 68*c* slides during movement of the slide cam 72 in the conveyance direction.

In this embodiment, the parallel part 76*b* of the slide surface 76*a*1 corresponds to a "first parallel surface" of the present teaching; the parallel part 76*d* of the slide surface 76*a*1 corresponds to a "second parallel surface" of the present teaching; the parallel part 76*c* of the slide surface 76*a*1 corresponds to a "third parallel surface" of the present teaching; the inclined part 76*e* of the slide surface 76*a*1 corresponds to a "first inclined surface" of the present teaching; and the inclined part 76*f* of the slide surface 76*a*1 corresponds to a "second inclined surface" of the present teaching.

The part 77 is narrower than the part 76 in width and extends downstream in the conveyance direction from the center of the downstream end of the part 76 in the conveyance direction. An arm supporting part 77*a* is provided at the downstream end of the part 77 in the conveyance direction. The arm supporting part 77*a* extends in the scanning direction to swingably support a first end of the arm 74. A gear 77*c* extending in the conveyance direction is formed in a left side surface 77*b* of the part 77 in the scanning direction. The slide cam 72 includes an oil damper 78 engaging with the gear 77*c*. The oil dumper 78 prevents the slide cam 72 from sliding (moving suddenly) in the conveyance direction as will be described later. A protruding part 77*d* extending in the conveyance direction is provided at a part, of the left side surface 77*b* of the part 77 in the scanning direction, which is downstream of the gear 77*c* in the conveyance direction. A guide member 80 (a "slide support part" of the present teaching) is provided on the left of the part 77 in the scanning direction. A groove 80*a* extending in the conveyance direction is formed on a right surface of the guide member 80 in the scanning direction. The protruding part 77*d* is inserted into the groove 80*a*. Moving the protruding part 77*d* along the groove 80*a* moves the slide cam 72 in the conveyance direction (a "slide direction" of the present teaching). The guide member 80 is fixed to an unillustrated frame provided in the printer 1.

The slide cam 72 includes a sensor 79 detecting a position in the conveyance direction. The sensor 79 includes a light emitting element 79*a* and a light receiving element 79*b*. The light emitting element 79*a* is disposed on the left of the part 77 in the scanning direction, and the light receiving element 79*b* is disposed on the right of the part 77 in the scanning direction. The light emitting element 79*a* emits light to the light receiving element 79*b*. The light receiving element 79*b* receives the light emitted from the light emitting element 79*a*. Further, a light blocking part 77*e* is provided in the lower surface of the part 77. Whether or not the light blocking part 77*e* blocks the light emitted from the light emitting element 79*a* is switched when the slide cam 72 moves in the conveyance direction, as described later. The sensor 79 becomes an off state, in which no signal is outputted, when the light receiving element 79*b* receives the light emitted from the light emitting element 79*a*, and the sensor 79 becomes an on state, in which the signal is outputted, when the light receiving element 79*b* does not receive the light emitted from the light emitting element 79*a*. The position of the slide cam 72 and the switching of the sensor 79 between the on and off states will be described later in detail.

The crank gear 73 is disposed such that its axis direction is parallel to the scanning direction. An arm supporting part 73*a* supporting a second end of the arm 74 swingably is provided at a part, of a side surface of the crank gear 73, deviated from the center of the crank gear 73. The crank gear 73 engages with a bevel gear 129.

<Switch Valve>

Figure 6:
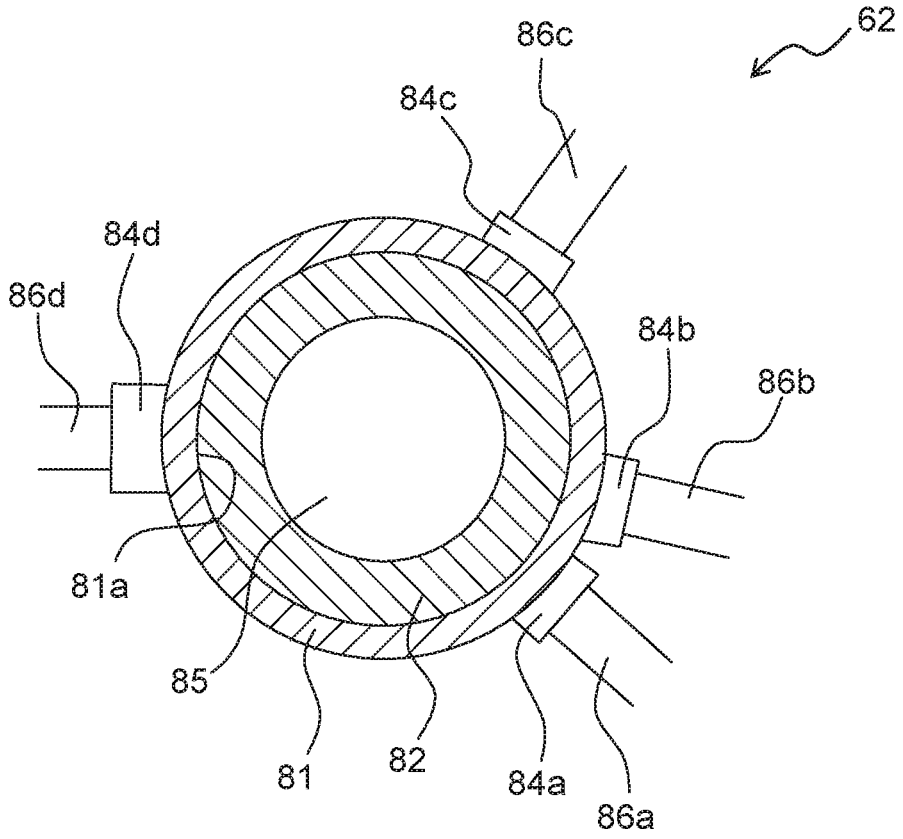
FIG. 6 is a cross-sectional view of the switch valve of FIG. 3A taken along the line VI-VI.

As depicted in FIGS. 3 and 6, the switch valve 62 includes an accommodating member 81 and a channel member 82. The accommodating member 81 is a cylindrical member of which lower end is closed. The accommodating member 81 includes two cap communicating ports 84*a*, 84*b*, an atmosphere communicating port 84*c*, and a pump communicating port 84*d*. The communicating ports 84*a* to 84*d* communicating with an internal space 81*a* protrude outward in a radial direction of the accommodating member 81 in mutually different directions. The cap communicating port 84*a* communicates with the cap 66*a* via a tube 86*a*. The cap communicating port 84*b* communicates with the cap 66*b* via a tube 86*b*. The atmosphere communicating port 84*c* communicates with the waste liquid tank 64 via a tube 86*c*. The pump communicating port 84*d* communicates with the suction pump 63 via a tube 86*d*.

The channel member 82, which is a cylindrical member made of a rubber material, is rotatably accommodated in the internal space 81*a* of the accommodating member 81. The channel member 82 includes, for example, unillustrated grooves forming ink channels to make the communicating ports 84*a* to 84*d* communicate with each other. The channel member 82 is mounted on a valve cam 85. The valve cam 85 is connected to a valve drive gear group 134 including a valve drive gear 134*a*. Since the structure of the switch valve 62 is the same as that of conventional ones, the more detailed explanation thereof is omitted.

<Selective Gear Mechanism>

In this embodiment, power can be selectively transmitted from the ASF motor 102 to any one of the cap lifting mechanism 71 and the switch valve 62 via a selective gear mechanism 136. More specifically, as depicted in FIG. 3A, FIG. 4A, and FIG. 4B, the selective gear mechanism 136 includes a selective drive gear 137, a bevel gear 138, and a planet gear mechanism 139. The selective drive gear 137, which is engageable with an ASF switch gear 122, is connected to the ASF motor 102 in a state of engaging with the ASF switch gear 122. The bevel gear 138 engages with the selective drive gear 137. The planet gear mechanism 139 includes a sun gear 139*a* and a planet gear 139*b*. The sun gear 139*a* engages with the bevel gear 138 and rotates together with the selective drive gear 137 and the bevel gear 138. The planet gear 139*b* engages with the sun gear 139*a*. The rotation of the sun gear 139*a* makes the planet gear 139*b* rotate about its own axis and an axis of the sun gear 139*a*.

When the ASF motor 102 rotates normally (clockwise) in a state where the selective drive gear 137 is connected to the ASF motor 102, power of the ASF motor 102 is transmitted to the gears 137, 138, 139*a*, and 139*b*. This rotates the sun gear 139*a* in the counterclockwise direction in FIG. 4A and rotates the planet gear 139*b* about the axis of the sun gear 139*a* within a horizontal plane in the clockwise direction in FIG. 4A, thereby engaging the planet gear 139*b* with the bevel gear 129, as depicted in FIG. 4A, FIG. 7A, FIG. 7B, FIG. 8A, and FIG. 8B. When the normal rotation of the ASF motor 102 is continued further in the above situation, power of the ASF motor 102 is transmitted to the crank gear 73 via the bevel gear 129 to rotate the crank gear 73 in the counterclockwise direction in FIG. 4A. Interlocked with the rotation of the crank gear 73, the slide cam 72 reciprocates in the conveyance direction.

When the slide cam 72 moves upstream in the conveyance direction, the cam follower 68*c* of the support member 68 slides on the parallel part 76*b*, the inclined part 76*e*, the parallel part 76*d*, the inclined part 76*f*, and the parallel part 76*c*, of the slide surface 76*a*1 of the groove 76*a*, in that order. This lowers the support member 68. The downward movement of the support member 68 lowers the cap unit 61 including the support member 68 and the nozzle cap 66. When the slide cam 72 moves downstream in the conveyance direction, the cam follower 68*c* of the support member 68 slides on the parallel part 76*c*, the inclined part 76*f*, the parallel part 76*d*, the inclined part 76*e*, and the parallel part 76*b*, of the slide surface 76*a*1 of the groove 76*a*, in that order. This raises the support member 68. The upward movement of the support member 68 raises the cap unit 61 including the support member 68 and the nozzle cap 66. In both cases, the oil damper 78 rotates while being interlocked with the movement of the slide cam 72. Accordingly, the cap lifting mechanism 71 converts the rotation of the crank gear 73 in one direction into the reciprocating movement of the slide cam 72 in the conveyance direction to make the cam follower 68*c* of the support member 68 slide on the slide surface 76*a*1 of the groove 76*a* of the slide cam 72, thereby moving the cap unit 61 up and down.

Figure 7A:
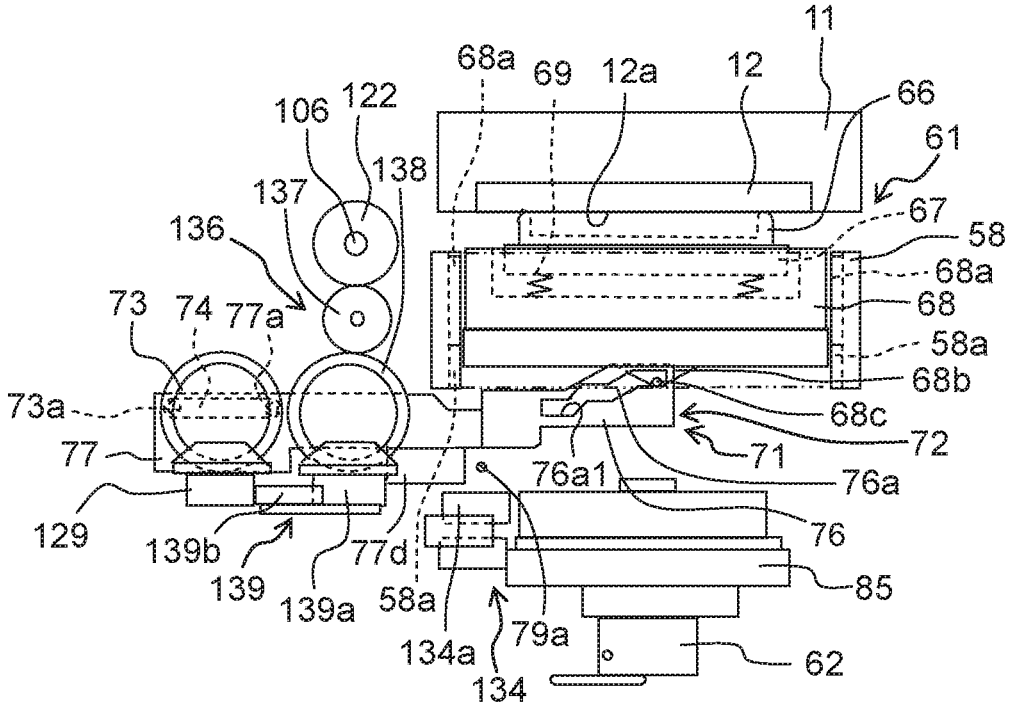
FIG. 7A is a diagram corresponding to FIG. 3A and depicting a state in which a cap is in a capping position.
Figure 7B:
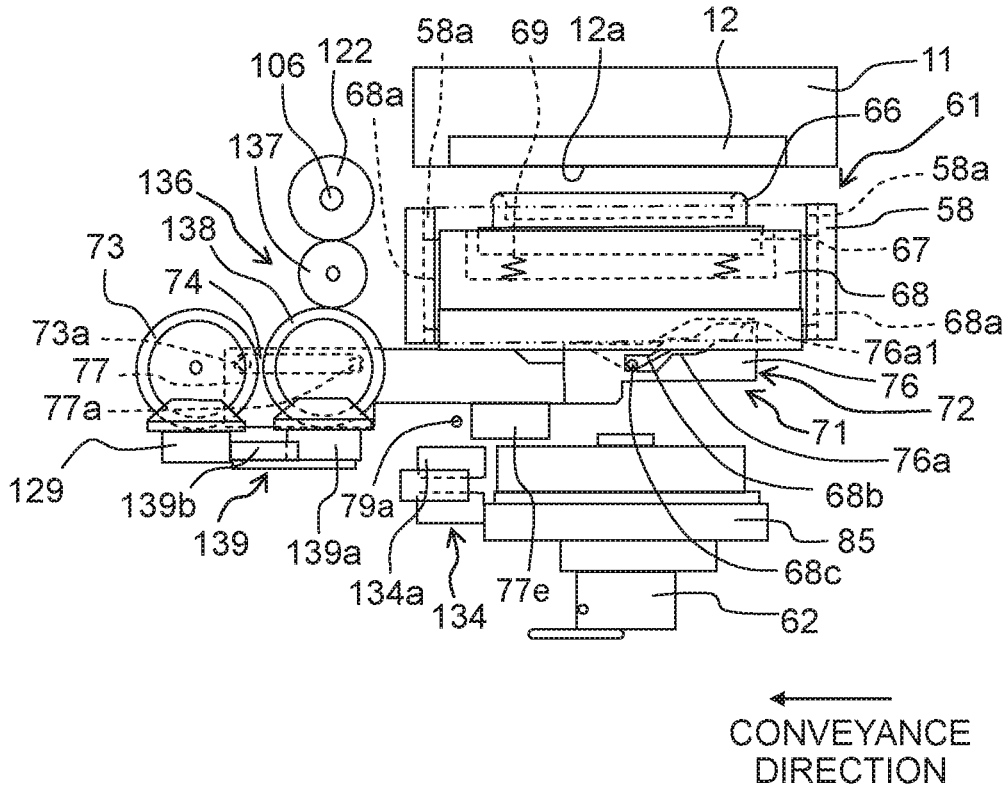
FIG. 7B is a diagram corresponding to FIG. 3A and depicting a state in which the cap is in an uncapping position.
Figure 8A:
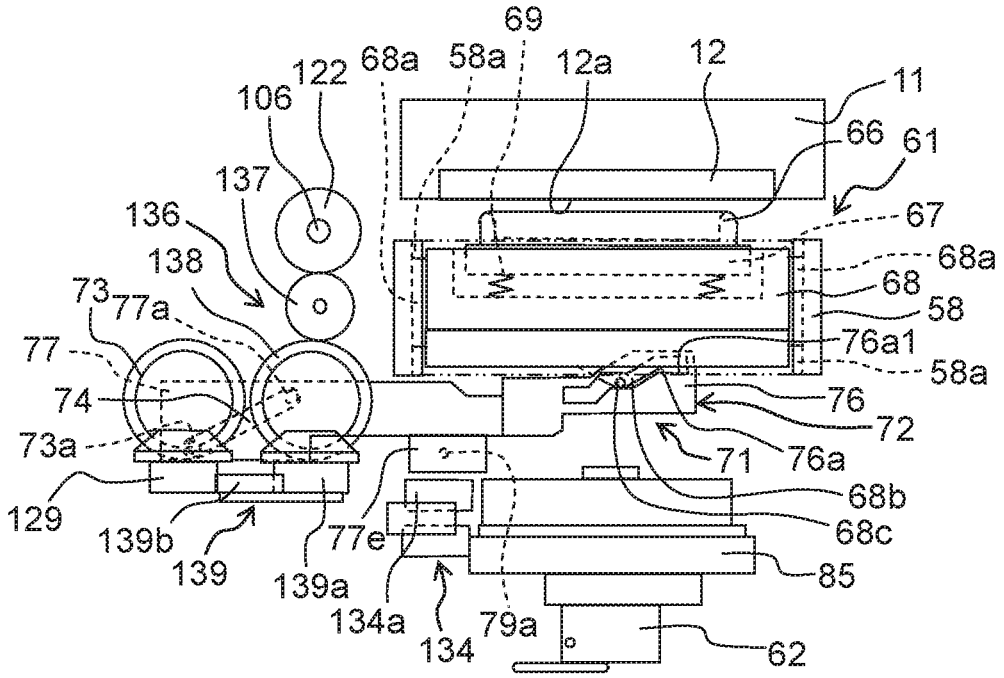
FIG. 8A is a diagram corresponding to FIG. 3A and depicting a state in which the cap is lowered to an intermediate position.
Figure 8B:
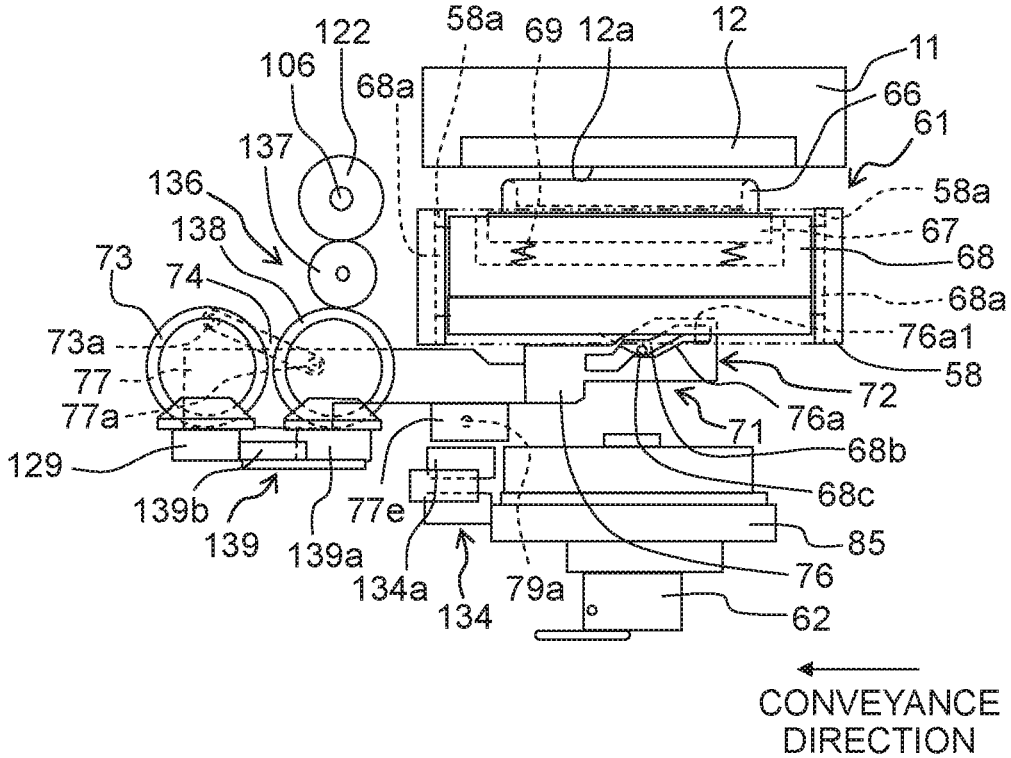
FIG. 8B is a diagram corresponding to FIG. 3A and depicting a state in which the cap is raised to the intermediate position.

As depicted in FIG. 7A, when the cam follower 68*c* is in the parallel part 76*b*, the nozzle cap 66 makes contact with the ink jetting surface 12*a* to cover nozzles 17 (in the following, this position of the nozzle cap 66 is to be referred to as a "capping position"). As depicted in FIG. 7B, when the cam follower 68*c* is in the parallel part 76*c*, the nozzle cap 66 is separated from the ink jetting surface 12*a* (in the following, this position of the nozzle cap 66 is to be referred to as an "uncapping position"). As depicted in FIGS. 8A and 8B, when the cam follower 68*c* is in the parallel part 76*d*, although the nozzle cap 66 is separated from the ink jetting surface 12*a*, the distance between the nozzle cap 66 and the ink jetting surface 12*a* is smaller than that of the case in which the cam follower 68*c* is in the parallel part 76*c* (in the following, this position of the nozzle cap 66 is to be referred to as an "intermediate position").

Figures 9A, 9B, 9C, 9D, 9E, 9F, 9G:
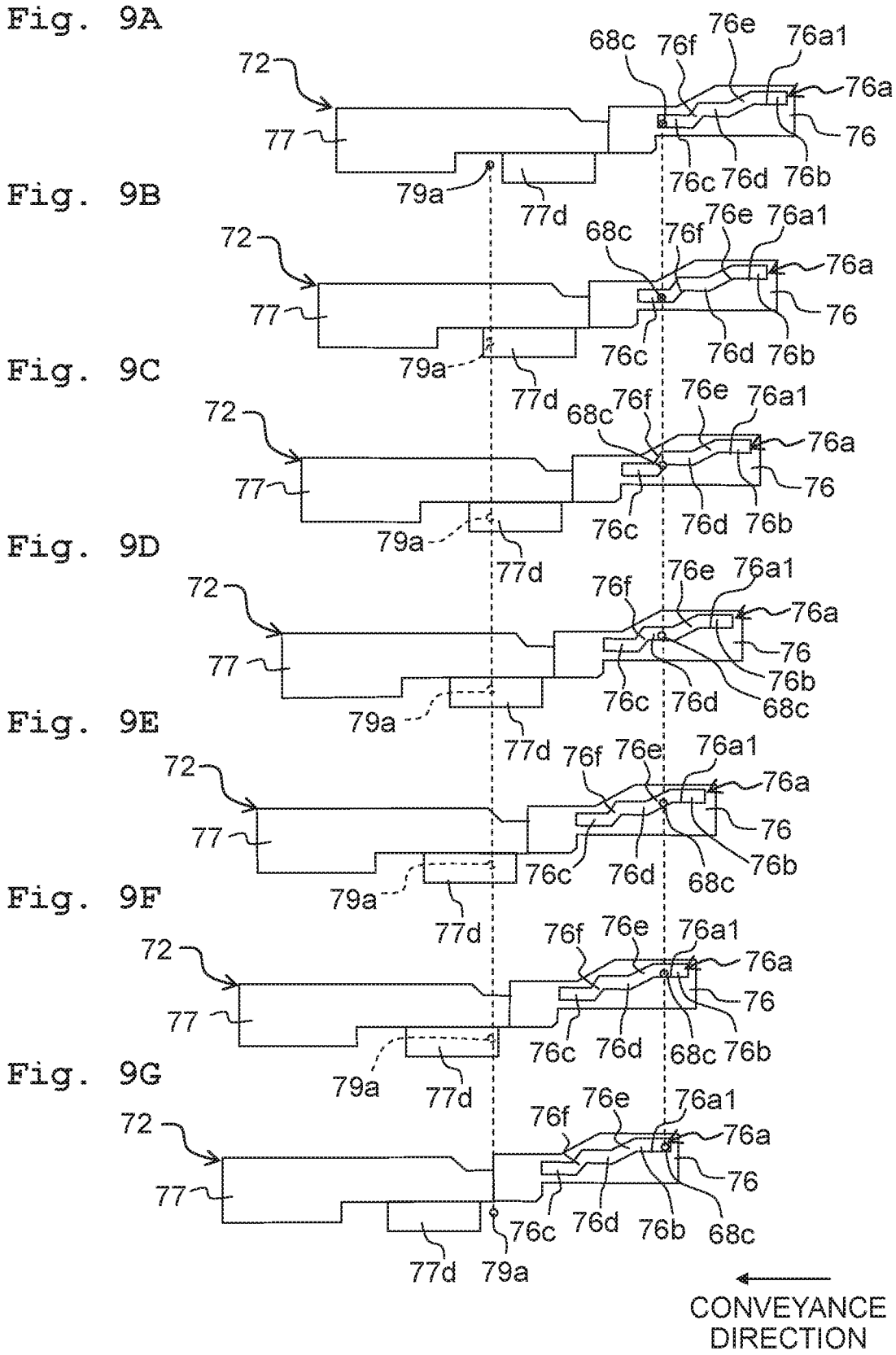
FIGS. 9A to 9G are diagrams each depicting a position of the slide cam and a detection state of a sensor.

Here, an explanation will be made about the control of the ASF motor 102 for moving the nozzle cap 66 between the capping position and the uncapping position and the intermediate position. In this embodiment, the light blocking part 77*e* does not face the light emitting element 79*a* and the light emitting element 79*b* when the cam follower 68*c* is positioned downstream (on the side opposite to the inclined part 760 of a predetermined point of the parallel part 76*c* (a point at which the cam follower 68*c* in FIG. 9B is positioned) in the conveyance direction as depicted in FIG. 9A and when the cam follower 68*c* is positioned upstream of a predetermined point of the parallel part 76*b* (a point at which the cam follower 68*c* in FIG. 9F is positioned) in the conveyance direction as depicted in FIG. 9G. As depicted in FIGS. 9B to 9F, the light blocking part 77*e* faces the light emitting element 79*a* and the light receiving element 79*b* when the cam follower 68*c* is positioned upstream (on the side of the inclined part 760 of the predetermined point of the parallel part 76*c* in the conveyance direction and downstream (on the side of the inclined part 76*e*) of the predetermined point of the parallel part 76*b* in the conveyance direction. For easy understanding, the length of the slide cam 72 in the conveyance direction depicted in FIGS. 9A to 9G is longer than that depicted in FIG. 3A.

On the basis of the above, in this embodiment, the ASF motor 102 is rotated normally in a state where the nozzle cap 66 is in the capping position as depicted in FIG. 7A, thereby moving the slide cam 72 in the conveyance direction. When the sensor 79 switches from the off state to the on state due to the movement of the slide cam 72, the ASF motor 102 is rotated further by a predetermined amount to move the nozzle cap 66 from the capping position to the intermediate position as depicted in FIG. 8A. In this situation, since the parallel part 76*d* extends parallel to the conveyance direction, even if the rotation amount of the ASF motor 102 after the sensor 79 switches from the off state to the on state varies slightly, the cam follower 68*c* is positioned in the parallel part 76*d* and the nozzle cap 66 is in the intermediate position reliably. Thus, even if the rotation amount of the ASF motor 102 after the sensor 79 switches from the off state to the on state varies slightly, the distance between the nozzle cap 66 and the ink jetting surface 12*a* does not vary.

In this embodiment, the ASF motor 102 is rotated further normally with the nozzle cap 66 being in the intermediate position. When the sensor 79 switches from the on state to the off state, the ASF motor 102 is rotated still further by a predetermined amount to move the nozzle cap 66 from the intermediate position to the uncapping position as depicted in FIG. 7B. Since the parallel part 76*c* extends parallel to the conveyance direction, even if the rotation amount of the ASF motor 102 after the sensor 79 switches from the on state to the off state varies slightly, the cam follower 68*c* is positioned in the parallel part 76*c* and the nozzle cap 66 is in the uncapping position reliably.

In this embodiment, the ASF motor 102 is rotated further normally with the nozzle cap 66 being in the uncapping position. When the sensor 79 switches from the off state to the on state, the ASF motor 102 is rotated still further by a predetermined amount to move the nozzle cap 66 from the uncapping position to the intermediate position as depicted in FIG. 8B. Since the parallel part 76*d* extends parallel to the conveyance direction, even if the rotation amount of the ASF motor 102 after the sensor 79 switches from the off state to the on state varies slightly, the cam follower 68*c* is positioned in the parallel part 76*d* and the nozzle cap 66 is in the intermediate position reliably. Namely, even if the rotation amount of the ASF motor 102 after the sensor 79 switches from the off state to the on state varies slightly, the distance between the nozzle cap 66 and the ink jetting surface 12*a* does not vary.

In this embodiment, the ASF motor 102 is rotated further normally with the nozzle cap 66 being in the intermediate position. When the sensor 79 switches from the on state to the off state, the ASF motor 102 is rotated still further by a predetermined amount to move the nozzle cap 66 from the intermediate position to the capping position as depicted in FIG. 7A. Since the parallel part 76*b* extends parallel to the conveyance direction, even if the rotation amount of the ASF motor 102 after the sensor 79 switches from the on state to the off state varies slightly, the cam follower 68*c* is positioned in the parallel part 76*b* and the nozzle cap 66 is in the capping position reliably.

When the nozzle cap 66 is moved between the capping position and the intermediate position and the uncapping position by rotating the ASF motor 102 normally to move the slide cam 72 reciprocatingly in the conveyance direction, the ASF motor 102 is rotated at a constant speed to move the slide cam 72 at a constant speed.

Figure 10:
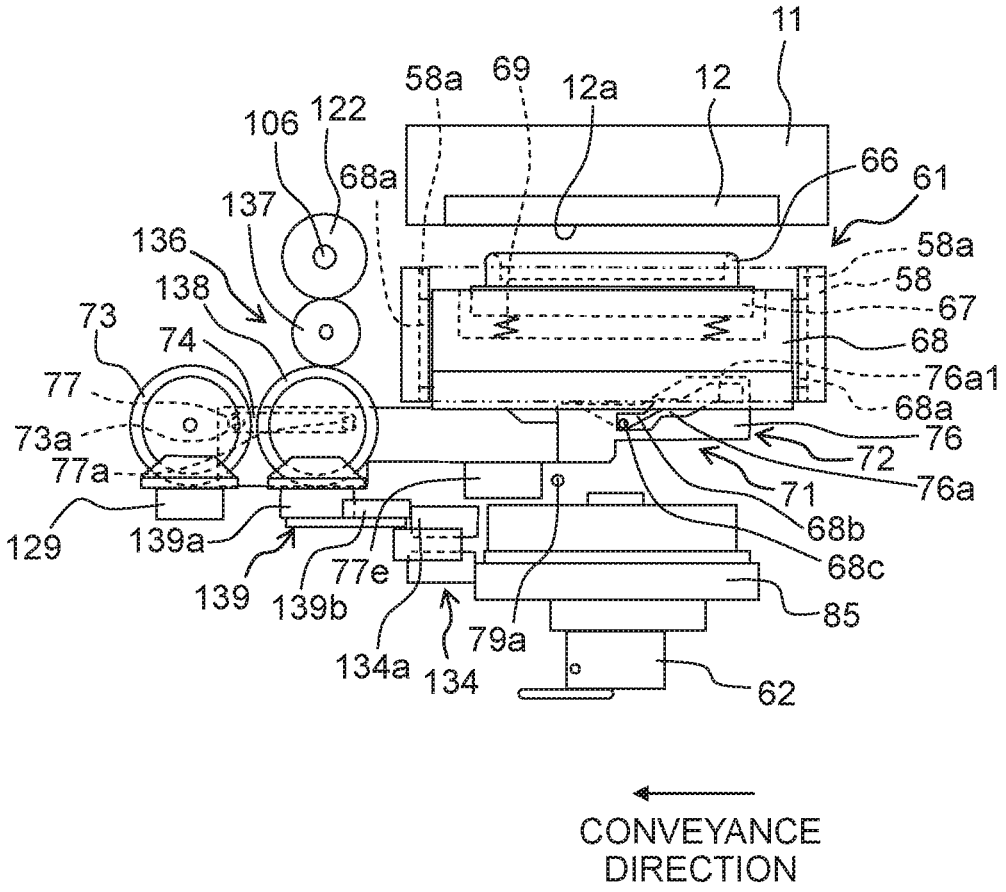
FIG. 10 is a diagram corresponding to FIG. 3A and depicting a state in which the switch valve is being driven.

When the ASF motor 102 is rotated counterclockwise with the selective drive gear 137 connected to the ASF motor 102, power of the ASF motor 102 is transmitted to the gears 137, 138, 139*a*, and 139*b*. This rotates the sun gear 139*a* in the clockwise direction in FIG. 4B and rotates the planet gear 139*b* about the axis of the sun gear 139*a* within a horizontal plane in the counterclockwise direction in FIG. 4B, thereby engaging the planet gear 139*b* with the valve drive gear 134*a*, as depicted in FIG. 4B and FIG. 10. When the ASF motor 102 is further rotated counterclockwise with the planet gear 139*b* engaging with the valve drive gear 134*a*, power of the ASF motor 102 is transmitted to the valve drive gear 134*a* to rotate respective gears constituting the valve drive gear group 134. This results in rotations of the valve cam 85 and the channel member 82. The rotation of the channel member 82 switches communication relations between the communicating ports 84*a* to 84*d* of the switch valve 62, such as the communication and non-communication between the cap communicating ports 84*a*, 84*b* and the pump communicating ports 84*d*.

Figure 11:
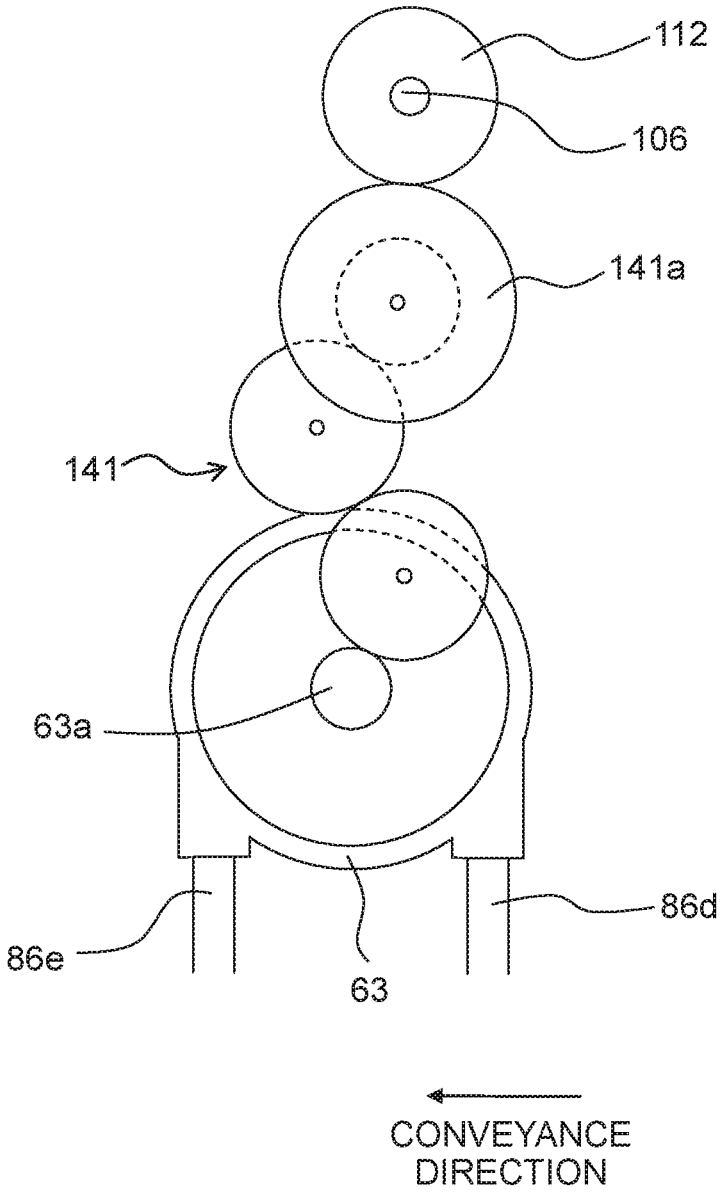
FIG. 11 depicts an arrangement of a suction pump and gears to be connected to the suction pump as viewed from the right in the scanning direction.

The suction pump 63 is a tube pump. As described above, the suction pump 63 communicates with the pump communicating port 84*d* of the switch valve 62 via the tube 86*d* and communicates with the waste liquid tank 64 via the tube 86*e* on the side opposite to the switch valve 62. As depicted in FIG. 11, the suction pump 63 includes a gear 63*a*. The gear 63*a*, which is connected to a pump drive gear group 141 including a pump drive gear 141*a*, is connectable to the PF motor 101 via the pump drive gear group 141 as will be described later. When the PF motor 101 is rotated normally with the suction pump 63 connected to the PF motor 101, power of the PF motor 101 is transmitted to the suction pump 63 to make the suction pump 63 the non-communication state in which the tube 86*d* does not communicate with the tube 86*e*. When the PF motor 101 is rotated further normally, the suction pump 63 performs suction. When the PF motor 101 is rotated reversely, power of the PF motor 101 is transmitted to the suction pump 63 to make the suction pump 63 the communication state in which the tube 86*d* communicates with the tube 86*e*. Since the tube pump which switches between the non-communication state and the communicating state according to the rotation direction is well known, more detailed explanation thereof is omitted here.

The waste liquid tank 64 receives, for example, the ink discharged through a suction purge, etc., as described later. The space of the waste liquid tank 64 in which the ink is received communicates with the atmosphere. Thus, the atmosphere communicating port 84*c*, which communicates with the waste liquid tank 64 via the tube 86*c*, communicates with the atmosphere. Further, when the suction pump 63 is in the communication state, the pump communicating port 84*d* communicates with the atmosphere via the tubes 86*d*, 86*e*, the suction pump 63, and the waste liquid tank 64.

<Switching of Motor Connection>

Subsequently, an explanation will be made about the switching of connection of each of the PF motor 101 and the ASF motor 102 with reference to FIGS. 12A to 12C and FIGS. 13A to 13C.

As depicted in FIGS. 12A to 12C and FIGS. 13A to 13C, the PF motor 101 is connected to a drive shaft 105. The drive roller 13*a* is mounted on the drive shaft 105. Further, a PF input gear 111 is mounted on the drive shaft 105. Driving the PF motor 101 rotates the drive shaft 105, the drive roller 13*a*, and the PF input gear 111 integrally.

The PF input gear 111 engages with a PF switch gear 112. The PF switch gear 112 is rotatably supported by a shaft 106 extending in the scanning direction. The PF switch gear 112 is movable, while being interlocked with movement of the carriage 11 in the scanning direction, along the shaft 106 in the scanning direction. Thus, the PF switch gear 112 can selectively move to any of the positions depicted in FIGS. 12A to 12C. The PF switch gear 112 does not engage with the pump drive gear 141*a* in the positions depicted in FIGS. 12A and 12B, and the PF switch gear 112 engages with the pump drive gear 141*a* in the position depicted in FIG. 12C. The PF switch gear 112 engages with the PF input gear 111 in all of the positions depicted in FIGS. 12A to 12C.

Figure 13A:
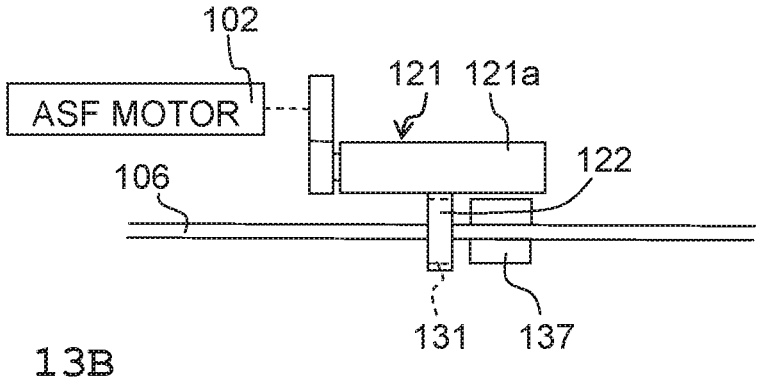
FIGS. 13A to 13C are diagrams each illustrating connection relations between an ASF motor and an ASF input gear and the ASF switch gear as well as the switching of connection by the ASF switch gear, FIG. 13A depicting a state corresponding to FIG. 12A, FIG. 13B depicting a state corresponding to FIG. 12B, FIG. 13C depicting a state corresponding to FIG. 12C.
Figure 13B:
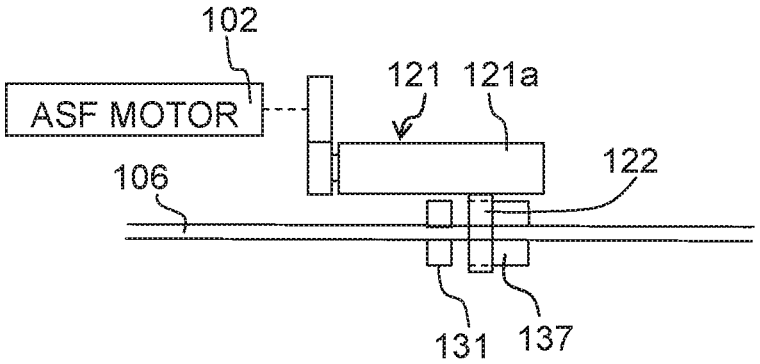
Figure 13C:
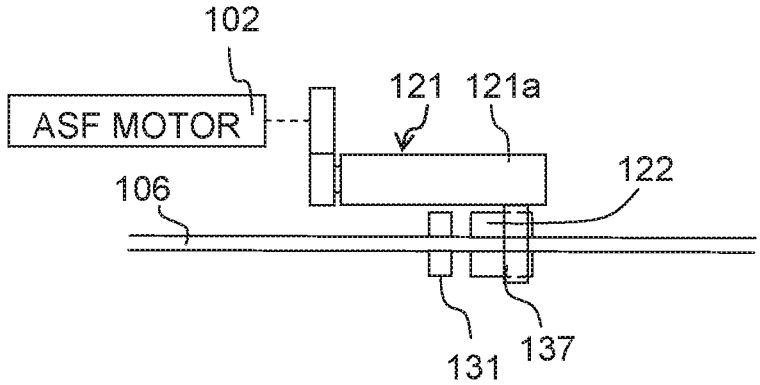

As depicted in FIGS. 13A to 13C, the ASF motor 102 is connected to an ASF input gear group 121. The ASF input gear group 121 includes an ASF input gear 121*a*, and the ASF input gear 121*a* engages with the ASF switch gear 122. The ASF switch gear 122 is rotatably supported by the shaft 106. The ASF switch gear 122 is mounted on the shaft 106 such that the positional relation between the ASF switch gear 122 and the PF switch gear 112 in the scanning direction is always kept. Thus, when the PF switch gear 112 moves while being interlocked with movement of the carriage 11 in the scanning direction, the ASF switch gear 122 also moves in the scanning direction.

In this embodiment, the ASF switch gear 122 can be selectively moved to any of the positions depicted in FIGS. 13A to 13C during its movement in the scanning direction. The ASF switch gear 122 in the position depicted in FIG. 13A engages with the feed gear 131. The ASF switch gear 122 in the positions depicted in FIGS. 13B and 13C engages with the selective drive gear 137.

<Controller>

Figure 14:
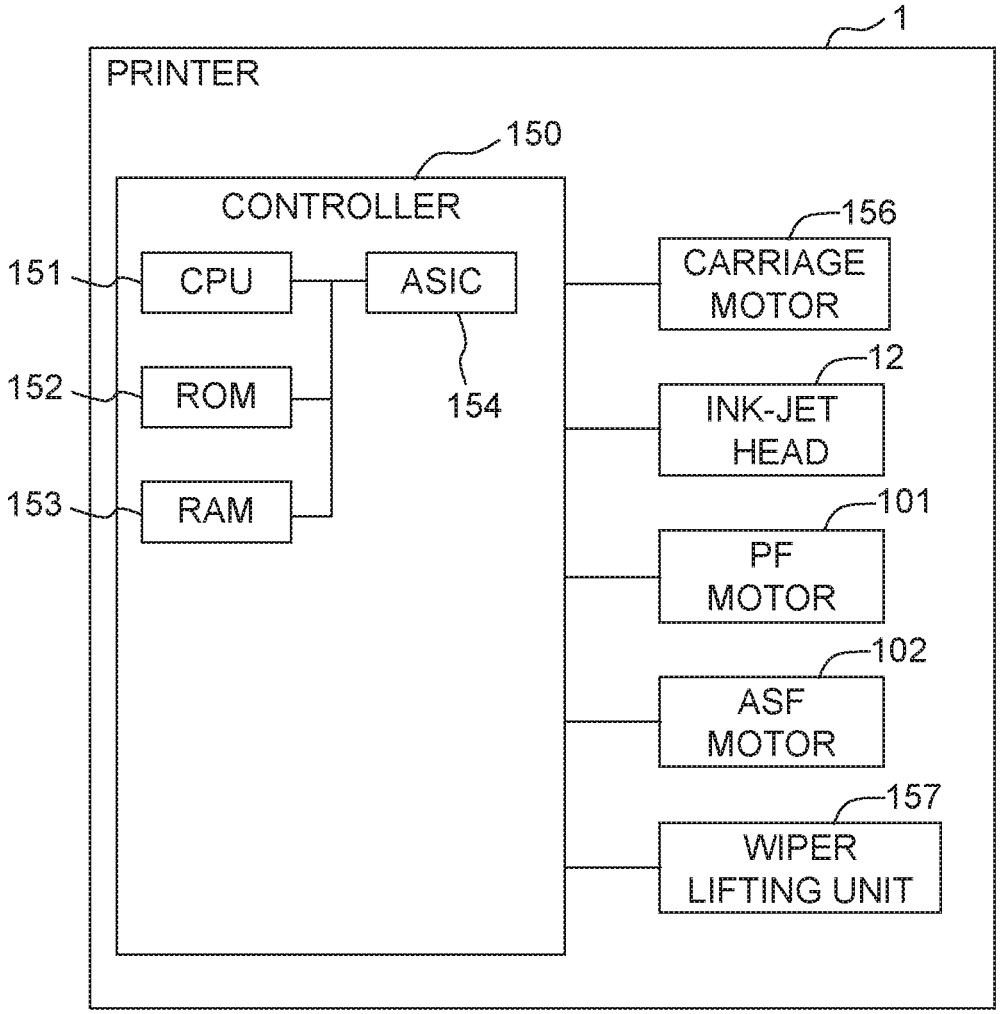
FIG. 14 is a block diagram depicting an electrical configuration of the printer.

Subsequently, an explanation will be made about a controller 150 which controls the operation of the printer 1. As depicted in FIG. 14, the controller 150 includes a Central Processing unit (CPU) 151, a Read Only Memory (ROM) 152, a Random Access Memory (RAM) 153, an Application Specific Integrated Circuit (ASIC) 154, and the like. They work cooperatively to control the operation of the carriage motor 156, the ink-jet head 12, the PF motor 101, the ASF motor 102, the wiper lifting unit 157, and the like.

The controller 150 may include the single CPU 151, as depicted in FIG. 14, to make the CPU 151 perform processing collectively or include a plurality of CPUs 151 to make the CPUs 151 perform processing in a shared manner. The controller 150 may include the single ASIC 154, as depicted in FIG. 14, to make the ASIC 154 perform processing collectively or include a plurality of ASICs 154 to make the ASICs 154 perform processing in a shared manner.

<Printing Operation>

Figure 15A:
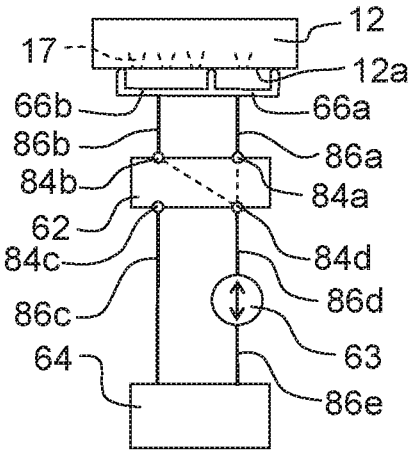
FIG. 15A to 15F are diagrams each depicting communication relations between a nozzle cap and the switch valve and the suction pump, FIG. 15A depicting a standby state, FIG. 15B depicting a state in which valve cleaning is being performed, FIG. 15C depicting a state in which a suction purge for black ink is being performed, FIG. 15D depicting a state in which a suction purge for color inks is being performed, FIG. 15E depicting a state in which idle suction for black ink is being performed, FIG. 15F depicting a state in which idle suction for color inks is being performed.

Subsequently, an explanation will be made about a method of performing printing with the printer 1. When the printer 1 is in a standby state in which no printing and no maintenance which will be described later are performed, the nozzle cap 66 is in the capping position. This makes the nozzle cap 66 contact with the ink jetting surface 12*a* to prevent the ink in nozzles 17 from being dried. In the standby state, as depicted in FIG. 15A, the cap communicating ports 84*a* and 84*b* of the switch valve 62 communicate with the pomp communicating port 84*d* of the switch valve 62. In the standby state, the suction pump 63 is in the communicating state. Thus, the caps 66*a* and 66*b* of the nozzle cap 66 covering the nozzles 17 communicate with the atmosphere via the suction pump 63 in the standby state. In the standby state, the PF switch gear 112 and the ASF switch gear 122 are in the positions depicted in FIG. 12C. In FIG. 15A, the two-headed arrow indicates the communicating state of the suction pump 63.

Figure 16:
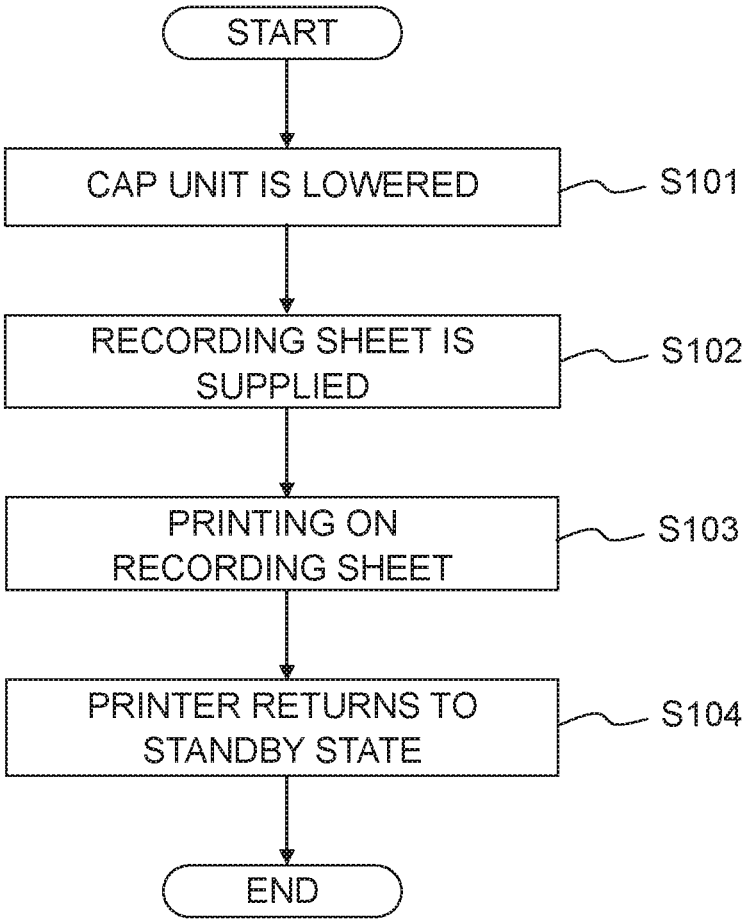
FIG. 16 is a flowchart of printing performed by the printer.

To make the printer 1 perform printing, at first, the ASF motor 102 is rotated normally to lower the nozzle cap 66 from the capping position to the uncapping position, as depicted in FIG. 16 (S101). Then, the carriage 11 is moved to move the PF switch gear 112 and ASF switch gear 122 to the position depicted in FIG. 12A, and the ASF motor 102 is rotated normally to supply the recording sheet P from the sheet cassette 21 to the printing unit 2 (S102).

Then, rotating the PF motor 101 normally makes the conveyance rollers 13 and 14 convey each supplied recording sheet P in the conveyance direction. The carriage motor 156 is driven to move the carriage 11 reciprocatively in the scanning direction and the ink-jet head 12 is driven to jet the ink from nozzles 17, thereby performing the printing on the recording sheet P (S103). After completion of the printing, the printer 1 returns to the standby state (S104). In particular, the carriage motor 156 is driven to move the carriage 11 to a position in which the ink jetting surface 12*a* faces the nozzle cap 66, and the ASF motor 102 is rotated normally in a state where the carriage 11 is in the above position to move the nozzle cap 66 from the uncapping position to the capping position, thereby making the nozzle cap 66 contact with the ink jetting surface 12*a*.

<Maintenance>

Figure 17:
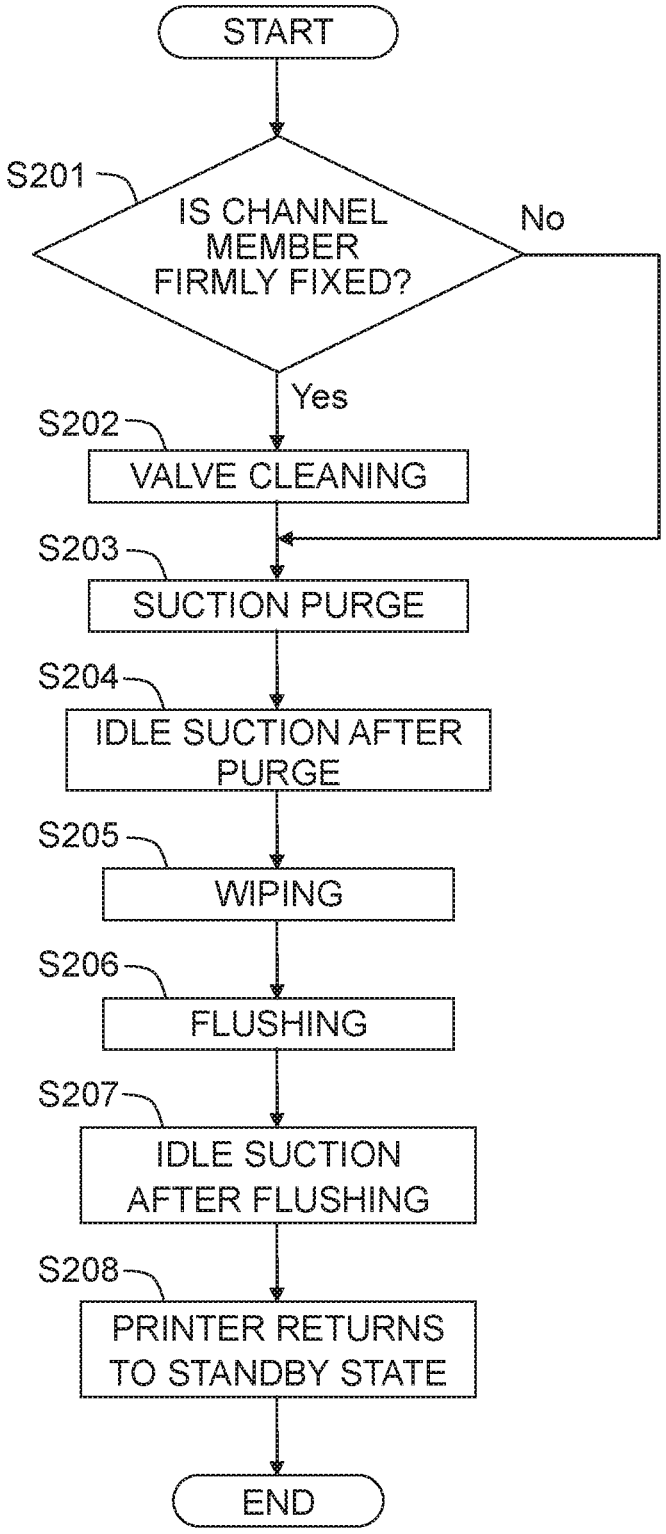
FIG. 17 is a flowchart of maintenance.

Subsequently, an explanation will be made about the maintenance using the maintenance unit 7. In the maintenance, as depicted in FIG. 17, the printer 1 first judges whether the channel member 82 is fixed so firmly to the accommodating member 81 that the channel member 82 can not rotate (S201). When the channel member 82 is not fixed firmly to the accommodating member 81 (S201: No), the process proceeds to S203. When the channel member 82 is fixed firmly to the accommodating member 81 (S201: Yes), valve cleaning is performed (S202) and the process proceeds to S203. In S201, for example, the judgement is made as follows. Namely, when the ASF motor 102 is rotated reversely for a prescribed time period with the printer 1 being in the standby state, the channel member 82 may not rotate. In that case, a current flowing through the ASF motor 102 will exceed a predetermined threshold value, which makes it possible for the printer 1 to judge that the channel member 82 is fixed firmly to the accommodating member 81.

Figure 15B:
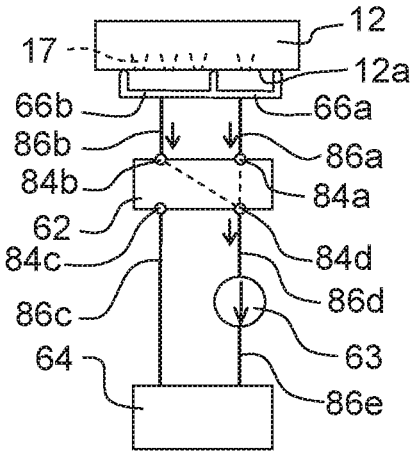

In the valve cleaning, as depicted in FIG. 15B, rotating the PF motor 101 normally with the printer 1 being in the standby state allows the suction pump 63 to perform suction. The ink accumulating in the ink-jet head 12 is discharged from nozzles 17 through the suction, flowing into the switch valve 62. The ink solidified in the switch valve 62 dissolves by absorbing the moisture or water of the ink flowing into the switch valve 62, thereby eliminating the firm fixation of the channel member 82 to the accommodating member 81. Further, the ASF motor 102 is rotated reversely during the suction with the suction pump 63 to rotate the channel member 82. This rotation allows the ink flowing into the switch valve 62 to spread over respective parts in the switch valve 62 uniformly, thereby making it possible to eliminate the firm fixation of the channel member 82 to the accommodating member 81 efficiently. In FIG. 15B, down arrows indicate a state in which the suction pump 63 in the non-communication state performs the suction. The same is true on FIGS. 15C to 15F.

When the suction purge or idle suction which will be described later is performed, the ink flows into the switch valve 62. If the ink flowing into the switch valve 62 is left for a long time, it may solidify to cause the channel member 82 to be firmly fixed to the accommodating member 81. The firm fixation of the channel member 82 to the accommodating member 81 may fail to rotate the channel member 82 during the suction purge or the idle suction. In this embodiment, the valve cleaning eliminates the firm fixation of the channel member 82 to the accommodating member 81.

In S203, the suction purge is performed. More specifically, in S203, both of a suction purge for black ink in which viscous black ink accumulating in the ink-jet head 12 is discharged and a suction purge for color inks in which viscous color inks accumulating in the ink-jet head 12 are discharged are performed successively.

Figure 12C:
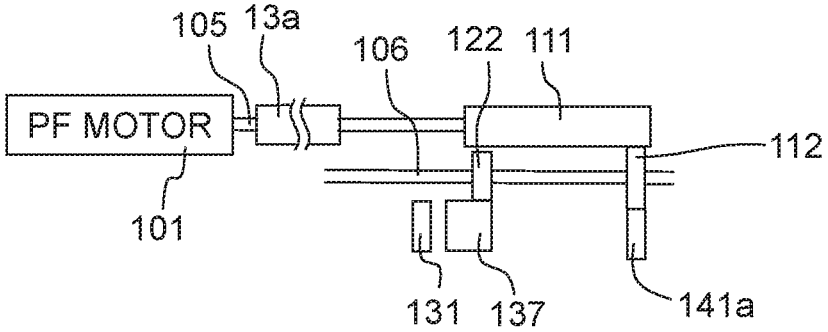
Figure 15C:
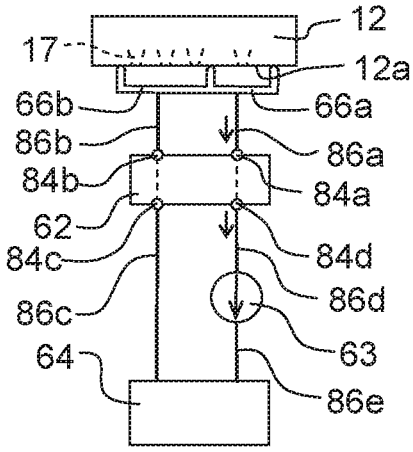

In the suction purge for black ink, the ASF motor 102 is rotated reversely to rotate the channel member 82 in a state where the nozzle cap 66 is in the capping position and the switch gears 112, 122 are in the positions depicted in FIG. 12C. The rotation of the channel member 82 allows the cap communicating port 84*a* to communicate with the pump communicating port 84*d* and allows the cap communicating port 84*b* to communicate with the atmosphere communicating port 84*c*, as depicted in FIG. 15C. In this situation, the PF motor 101 is rotated normally to make the suction pump 63 perform the suction. Accordingly, the viscous black ink accumulating in the ink-jet head 12 is discharged from the nozzles 17 forming the rightmost nozzle row 18. The reason why the cap communicating port 84*b* is allowed to communicate with the atmosphere communicating port 84*c* is that this prevents the increase in pressure in the cap 66*b* which would be otherwise caused when deformation of the nozzle cap 66 during the suction reduces the volume of the space in the nozzle cap 66*b*.

Figure 15D:
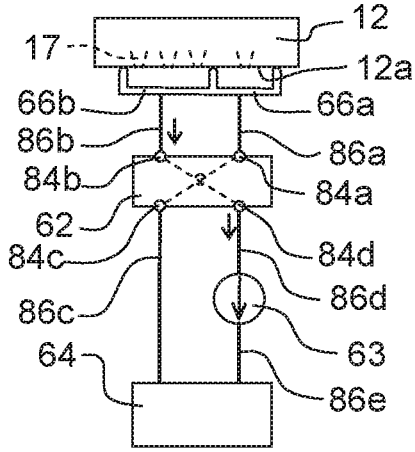

In the suction purge for color inks, the ASF motor 102 is rotated reversely to rotate the channel member 82 in the state where the nozzle cap 66 is in the capping position and the switch gears 112, 122 are in the positions depicted in FIG. 12C. The rotation of the channel member 82 allows the cap communicating port 84*b* to communicate with the pump communicating port 84*d* and allows the cap communicating port 84*a* to communicate with the atmosphere communicating port 84*c*, as depicted in FIG. 15D. In this situation, the PF motor 101 is rotated normally to make the suction pump 63 perform the suction. Accordingly, the viscous color inks accumulating in the ink-jet head 12 are discharged from the nozzles 17 forming the three nozzle rows 18 on the left of the rightmost nozzle row 18. The reason why the cap communicating port 84*a* is allowed to communicate with the atmosphere communicating port 84*c* is that this prevents the increase in pressure in the cap 66*a* which would be otherwise caused when deformation of the nozzle cap 66 during the suction reduces the volume of the space in the nozzle cap 66*a*.

Subsequently, the idle suction, in which the ink accumulating in the nozzle cap 66 is discharged, is performed (S204). More specifically, in S204, both of the idle suction for black ink in which the black ink accumulating in the nozzle cap 66*a* is discharged by the suction purge for black ink and the idle suction for color inks in which the color inks accumulating in the nozzle cap 66*b* are discharged by the suction purge for color inks are performed successively.

Figure 15E:
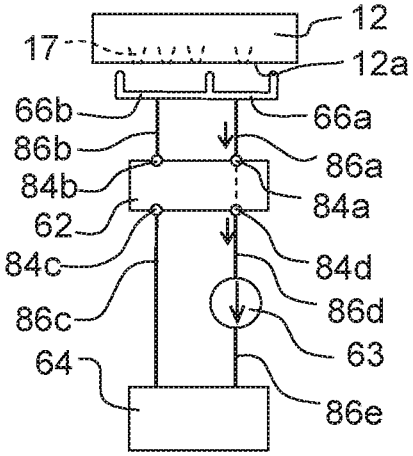

In the idle suction for black ink, the ASF motor 102 is rotated normally to rotate the crank gear 73 in a state where the switch gears 112, 122 are in the positions depicted in FIG. 12C. The rotation of the crank gear 73 lowers the nozzle cap 66 from the capping position to the intermediate position, as depicted in FIG. 8A. Subsequently, the ASF motor 102 is rotated reversely to rotate the channel member 82. The rotation of the channel member 82 allows the cap communicating port 84*a* to communicate with the pump communicating port 84*d*, as depicted in FIG. 15E. In this situation, the PF motor 101 is rotated normally to make the suction pump 63 perform the suction. Accordingly, the black ink accumulating in the nozzle cap 66*a* is discharged.

Figure 15F:
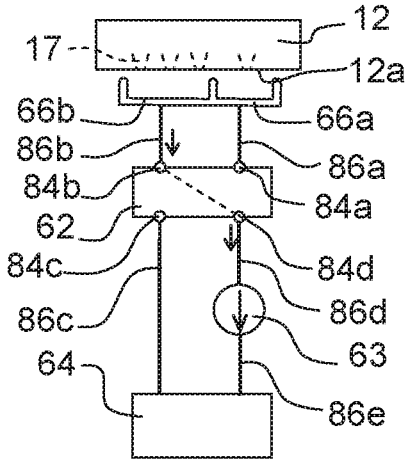

In the idle suction for color inks, the ASF motor 102 is rotated reversely to rotate the channel member 82 in a state where the nozzle cap 66 is in the intermediate position as depicted in FIG. 8A. The rotation of the channel member 82 allows the cap communicating port 84*b* to communicate with the pump communicating port 84*d*, as depicted in FIG. 15F. In this situation, the PF motor 101 is rotated normally to make the suction pump 63 perform the suction. Accordingly, the color inks accumulating in the cap 66*b* are discharged.

In some cases, except this embodiment, the ink (bridge) between the nozzle cap 66 and the ink jetting surface 12*a* may be broken when the nozzle cap 66 is lowered from the capping position to the uncapping position in the idle suction to separate the nozzle cap 66 from the ink jetting surface 12*a*. This may cause the ink to be scattered around the nozzle cap 66. In this embodiment, the nozzle cap 66 is lowered to the intermediate position in the idle suction, and the height of the intermediate position of the nozzle cap 66 is designed such that the ink bridge is not broken when the nozzle cap 66 is lowered to the intermediate position. Thus, in this embodiment, it is possible to prevent the ink from being scattered around the nozzle cap 66 which would be otherwise caused by the destruction of ink bridge in the idle suction.

Subsequently, wiping is performed to wipe the ink adhering to the ink jetting surface 12*a* by using the wiper 59 (S205). To perform the wiping, the ASF motor 102 is rotated normally to rotate the crank gear 73. The rotation of the crank gear 73 lowers the nozzle cap 66 to the uncapping position, as depicted in FIG. 7B. Further, the wiper lifting unit 157 is driven to move the wiper 59 upward, and the carriage motor 156 is driven to move the carriage 11 in the scanning direction. Accordingly, the ink adhering to the ink jetting surface 12*a* is wiped using the wiper 59. If the nozzle cap 66 is in the intermediate position during the wiping, the ink jetting surface 12*a* may make contact with the nozzle cap 66 during the movement of the carriage 11 in the scanning direction, because the distance between the nozzle cap 66 and the ink jetting surface 12*a* in the state where the nozzle cap 66 is in the intermediate position is smaller than that of the case in which the nozzle cap 66 is in the uncapping position. In this embodiment, in order to prevent the ink jetting surface 12*a* from making contact with the nozzle cap 66, the nozzle cap 66 is lowered from the intermediate position to the uncapping position before the start of the wiping operation.

Subsequently, flushing is performed to discharge, from nozzles 17, the ink and the like flowing into the nozzles 17 during the wiping (S206). To perform the flushing, the carriage motor 156 is driven to return the carriage 11 to the position where the ink jetting surface 12*a* faces the nozzle cap 66. Then, the ASF motor 102 is rotated normally to rotate the crank gear 73. The rotation of the crank gear 73 raises the nozzle cap 66 up to the intermediate position, as depicted in FIG. 8B. In this situation, the ink is discharged from the nozzles 17 of the ink-jet head 12 to the nozzle cap 66.

In some cases, except for this embodiment, the flashing may be performed in a state where the nozzle cap 66 is in the uncapping position. In that case, the ink jetted from the nozzles 17 through the flushing may be spattered on the nozzle cap 66 to fly out of the nozzle cap 66. In this embodiment, during the flushing, the nozzle cap 66 is in the intermediate position which is closer to the ink jetting surface 12*a* than the uncapping position. This prevents the ink jetted from nozzles 17 through the flushing from being spattered on the nozzle cap 66 to fly out of the nozzle cap 66.

Subsequently, the idle suction similar to S204 is performed to discharge the ink accumulating in the nozzle cap 66 during the flushing (S207). After completion of the idle suction in S207, the ASF motor 102 is rotated normally to move the nozzle cap 66 to the capping position as depicted in FIG. 7A, and the printer 1 returns to the standby state (S208). Accordingly, the maintenance is completed.

To shorten the time from the standby state to the start of printing as much as possible (the time of S102), the printer 1 is required to shorten the time required for movement of the nozzle cap 66 from the capping position to the uncapping position as much as possible. In this embodiment, the cap unit 61 is moved up and down by moving the slide cam 72 in the conveyance direction to cause the cam follower 68*c* slide on the slide surface 76*a*1. Thus, the amounts of upward and downward movement of the cap unit 61 relative to the movement amount of the slide cam 72 in the conveyance direction increase, as the inclined angles θ1 and 02, of the inclined parts 76*e* and 76*f* of the groove 76*a* of the slide cam 72, relative to the conveyance direction are greater, which in turn results in reduction of the time required for movement of the nozzle cap 66 from the capping position to the uncapping position.

However, if the inclined angle θ1 is too great, the nozzle cap 66 moves fast in the up-down direction when separating from the ink jetting surface 12*a*. In that case, the ink (bridge) between the nozzle cap 66 and the ink jetting surface 12*a* may be broken when the nozzle cap 66 is moved from the capping position to the intermediate position to perform the idle suction after the suction purge. This may cause the ink to be scattered around the nozzle cap 66. Further, if the nozzle cap 66 moves fast in the up-down direction when separating from the ink jetting surface 12*a*, the atmospheric pressure in each nozzle 17 may suddenly change to break the meniscus of ink in the nozzle 17.

For example, if the inclined angle θ1 is too great, the nozzle cap 66 moves fast in the up-down direction when returning to the capping position to make contact with the ink jetting surface 12*a* after completion of printing or maintenance. This increases the impact or shock caused by the collision between the nozzle cap 66 and the ink jetting surface 12 to cause the spring 69 to temporarily contract greater than a final contraction amount (a contraction amount when the nozzle cap 66 is in the capping state), which results in great force applied to the ink jetting surface 12*a* and the nozzle cap 66. The great force on the nozzle cap 66 increases the burden on the ASF motor 102 which is a power source moving the cap unit 61 upward.

Thus, in this embodiment, the inclined angle θ1 is made to be smaller than the inclined angle θ2. This reduces the movement speed of the nozzle cap 66 in the up-down direction when the nozzle cap 66 makes contact with and separates from the ink jetting surface 12*a*, thereby avoiding the above problem.

When the inclined angle θ2 is greater than the inclined angle θ1, the time required for movement of the nozzle cap 66 between the capping position and the uncapping position is shorter than the case in which the inclined angle θ2 is equal to or smaller than the inclined angle θ1. Namely, the time required for movement of the nozzle cap 66 between the capping position and the uncapping position is reduced by making the movement speed of the nozzle cap 66 (corresponding to a second movement speed of the present teaching) during the process for moving the nozzle cap 66 from the intermediate position to the uncapping position (corresponding to a second movement process of the present teaching) faster than the movement speed of the nozzle cap 66 (corresponding to a first movement speed of the present teaching) during the process for moving the nozzle cap 66 from the capping position to the intermediate position (corresponding to a first movement process of the present teaching). Accordingly, the time from the standby state to the start of printing can be shortened as much as possible.

As described above, since the inclined angle θ1 of the inclined part 76*e* is smaller than the inclined angle θ2 of the inclined part 76*f* in this embodiment, the time required for movement of the nozzle cap 66 between the capping position and the uncapping position is shorter than the case in which both of the inclined angles of the inclined parts 76*e* and 76*f* are θ1. Further, the movement speed of the nozzle cap 66 in the up-down direction when the nozzle cap 66 makes contact with and separates from the ink jetting surface 12*a* is slower than the case in which both of the inclined angles of the inclined parts 76*e* and 76*f* are θ2.

Thus, this embodiment achieves, in a balanced manner, both reduction of the time required for movement of the nozzle cap 66 between the capping position and the uncapping position and reduction of the movement speed of the nozzle cap 66 in the up-down direction when the nozzle cap 66 makes contact with and separates from the ink-jet ting surface 12, unlike the case in which the inclined angles of the inclined parts 76*e* and 76*f* are both θ1 and the case in which the inclined angles of the inclined parts 76*e* and 76*f* are both θ2.

In this embodiment, although the ASF motor 102 is rotated at the constant speed to move the slide cam 72 at the constant speed in the conveyance direction, the movement speed of the cap unit 61 in the up-down direction between the capping position and the intermediate position is slower than that between the uncapping position and the intermediate position. This effect is brought about by making the inclined angle θ1 of the inclined part 76*e* smaller than the inclined angle θ2 of the inclined part 76*f*. Namely, the present teaching does not need the control that causes the rotation speed of the ASF motor 102 during movement of the nozzle cap 66 between the capping position and the intermediate position to differ from that during movement of the nozzle cap 66 between the uncapping position and the intermediate position, resulting in simple control of the ASF motor 102.

In this embodiment, the length L2 of the inclined part 76*f* in the movement direction (conveyance direction) of the slide cam 72 is shorter than the length L1 of the inclined part 76*e*. This reduces the movement range of the slide cam 72 in the conveyance direction and the length of the slide cam 72 in the conveyance direction.

Subsequently, an explanation will be made about modified examples in which various modifications are added to the above embodiment.

In the above embodiment, the length L2 of the inclined part 76*f* in the movement direction of the slide cam 72 is shorter than the length L1 of the inclined part 76*e*. The present teaching, however, is not limited thereto. The length L2 of the inclined part 76*f* may be equal to or longer than the length L1 of the inclined part 76*e*.

In the above embodiment, the cap holder 67 supports the nozzle cap 66 and the spring 69 urges the nozzle cap 66 via the cap holder 67. The present teaching, however, is not limited thereto. For example, if the rigidity of a bottom part of the nozzle cap 66 is sufficiently high, the cap holder 67 may not be provided and the spring 69 may directly urge the nozzle cap 66.

In the above embodiment, the spring 69 urges the nozzle cap 66. The present teaching, however, is not limited thereto. For example, the spring 69 may not be provided, and the nozzle cap 66 may be directly fixed to the support member 68.

In the above embodiment, the groove 76*a* includes the parallel parts 76*b*, 76*c*, and 76*d*; the cam follower 68*c* is in the parallel part 76*b* with the nozzle cap 66 being in the capping position; the cam follower 68*c* is in the parallel part 76*c* with the nozzle cap 66 being in the uncapping position; and the cam follower 68*c* is in the parallel part 76*d* with the nozzle cap 66 being in the intermediate position. The present teaching, however, is not limited thereto.

Figure 18A:
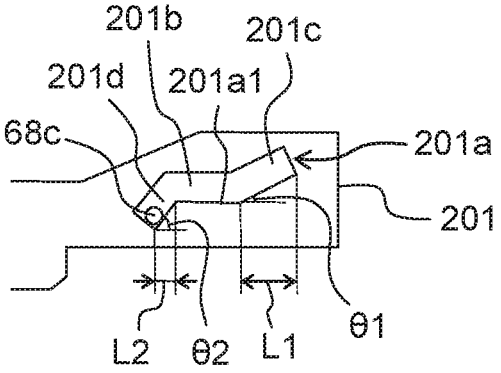
FIG. 18A is a diagram of a first modified example corresponding to FIG. 3B.

For example, in a first modified example, a slide cam 201 includes a groove 201*a* and a lower surface of the groove 201*a* is a slide surface 201*a*1 on which the cam follower 68*c* slides, as depicted in FIG. 18A. The groove 201*a* includes a parallel part 201*b* similar to the parallel part 76*d* (see FIG. 3B), an inclined part 201*c* similar to the inclined part 76*e*

(see FIG. 3B), and an inclined part 201*d* similar to the inclined part 76*f* (see FIG. 3B). The groove 201*a* does not include parts corresponding to the parallel parts 76*b* and 76*c* (see FIG. 3B). In the first modified example, the parallel part 201*b* of the slide surface 201*a*1 corresponds to the "parallel surface" of the present teaching; the inclined part 201*c* corresponds to the "first inclined surface" of the present teaching; and the inclined part 201*d* corresponds to the "second inclined surface" of the present teaching.

Figure 18B:
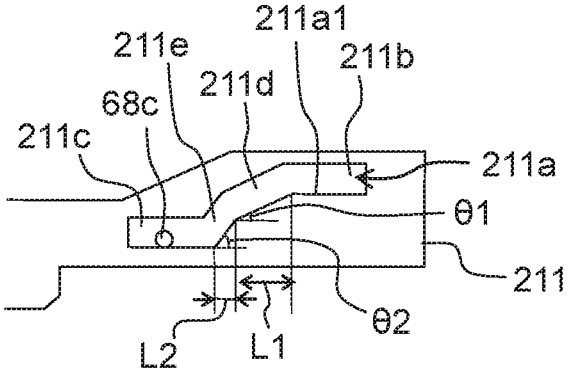
FIG. 18B is a diagram of a second modified example corresponding to FIG. 3B.

In a second modified example, a slide cam 211 includes a groove 211*a* and a lower surface of the groove 211*a* is a slide surface 211*a*1 on which the cam follower 68*c* slides, as depicted in FIG. 18B. The groove 211*a* includes parallel parts 211*b* and 211*c* similar to the parallel parts 76*b* and 76*c* (see FIG. 3B), an inclined part 211*d* similar to the inclined part 76*e* (see FIG. 3B), and an inclined part 211*e* similar to the inclined part 76*f* (see FIG. 3B). The inclined part 211*d* is directly connected to the inclined part 211*e*. The groove 211*a* does not include a part corresponding to the parallel part 76*d* (see FIG. 3B). In the second modified example, the inclined part 211*d* of the slide surface 211*a*1 corresponds to the "first inclined surface" of the present teaching and the inclined part 211*e* corresponds to the "second inclined surface" of the present teaching.

Figure 18C:
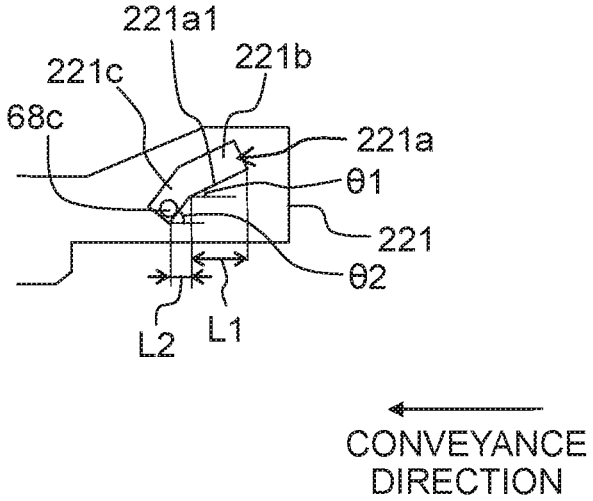
FIG. 18C is a diagram of a third modified example corresponding to FIG. 3B.

In a third modified example, a slide cam 221 includes a groove 221*a* and a lower surface of the groove 221*a* is a slide surface 221*a*1 on which the cam follower 68*c* slides, as depicted in FIG. 18C. The groove 221*a* includes an inclined part 221*b* similar to the inclined part 76*e* (see FIG. 3B) and an inclined part 221*c* similar to the inclined part 76*f* (see FIG. 3B). The inclined part 221*b* is directly connected to the inclined part 221*c*. The groove 221*a* does not include parts corresponding to the parallel parts 76*b* to 76*d* (see FIG. 3B). In the third modified example, the inclined part 221*b* of the slide surface 221*a*1 corresponds to the "first inclined surface" of the present teaching and the inclined part 221*c* corresponds to the "second inclined surface" of the present teaching.

In the above modified examples, the inclined angle θ1 of each of the inclined parts 201*c*, 211*d*, and 221*b* relative to the conveyance direction is smaller than the inclined angle θ2 of each of the inclined parts 201*d*, 211*e*, and 221*c* relative to the conveyance direction, like the above embodiment. Thus, the ink is prevented from being scattered around the nozzle cap 66 and the meniscus of ink in each nozzle 17 is prevented from being broken when the nozzle cap 66 separates from the ink jetting surface 12*a*. Further, it is possible to prevent great force from being applied on the nozzle cap 66 and the ink jetting surface 12*a* when the nozzle cap 66 makes contact with the ink jetting surface 12*a*. Furthermore, it is possible to shorten the time required for movement of the nozzle cap 66 between the capping position and the uncapping position as much as possible.

In the above embodiment, only the lower surface of the groove 76*a* is the slide surface on which the cam follower 68*c* slides. The present teaching, however, is not limited thereto. For example, the height of the cam follower 68*c* may be substantially the same as that of the groove 76*a* and both of the upper surface and the lower surface of the groove 76*a* may be slide surfaces on which the cam follower 68*c* slides. In that case, the parallel part 76*c* of the upper and lower surfaces of the groove 76*a* corresponds to the "parallel surface" of the present teaching; the inclined part 76*e* of the upper and lower surfaces of the groove 76*a* corresponds to the "first inclined surface" of the present teaching; and the inclined part 76*f* of the upper and lower surfaces of the groove 76*a* corresponds to the "second inclined surface" of the present teaching.

In the above embodiment, the slide cam 72 including the groove 76*a* with the slide surface 76*a*1 can reciprocate in the conveyance direction by power from the ASF motor 102, and the support member 68 of the cap unit 61 includes the cam follower 68*c* sliding on the slide surface 76*a*1. The present teaching, however, is not limited thereto. For example, the following configuration is also allowable. Namely, the support member 68 of the cap unit 61 is formed as a cam including a groove similar to the groove 76*a*, and a cam follower sliding on a slide surface of the groove is reciprocatingly movable in the conveyance direction by power from the ASF motor 102.

In the above embodiment, the cam follower 68*c* is provided in the support member 68 supporting the nozzle cap 66 from below. The present teaching, however, is not limited thereto. For example, the cam follower may be directly provided in the nozzle cap 66. Or, when the cam follower is reciprocatingly movable in the conveyance direction by power from the ASF motor 102 as described above, the cam including the groove similar to the groove 76*a* may be directly provided in the nozzle cap 66.

In the above embodiment, when the nozzle cap 66 moves between the capping position and the intermediate position and the uncapping position, the ASF motor 102 is rotated at the constant speed to move the slide cam 72 at the constant speed. The present teaching, however, is not limited thereto. For example, to achieve a slower movement speed of the nozzle cap 66 in the up-down direction when the nozzle cap 66 makes contact with and separates from the ink jetting surface 12*a*, rotation speed of the ASF motor 102 when the nozzle cap 66 moves between the capping position and the intermediate position may be slower than that of the above embodiment. Or, to achieve a faster movement speed of the nozzle cap 66 in the up-down direction when the nozzle cap 66 moves between the uncapping position and the intermediate position, rotation speed of the ASF motor 102 when the nozzle cap 66 moves between the uncapping position and the intermediate position may be faster than that of the above embodiment.

The configuration for moving the slide cam 72 in the conveyance direction is not limited to that of the above embodiment. A configuration for moving the slide cam 72 which is different from that of the above embodiment may move the slide cam 72 in the conveyance direction. For example, the following configuration is also allowable. Namely, the gear arrangement connecting the ASF motor 102 and the slide cam 72 is different from that of the above embodiment, and the slide cam 72 moves upstream in the conveyance direction when the ASF motor 102 rotates in one direction and the slide cam 72 moves downstream in the conveyance direction when the ASF motor 102 rotates in the opposite direction of the one direction. Or, the slide cam 72 may be moved in the conveyance direction by power from another motor, such as the PF motor 101.

The configuration for moving the nozzle cap 66 up and down is not limited to that of the above embodiment. For example, in the third modified example described above, the following configuration is also allowable. Namely, a pressed portion extending upwardly is provided for the nozzle cap 66 at one end portion thereof in the scanning direction (on the right side in FIG. 1). The grooves 221*a* are formed at both ends of the slide cam 221 in the conveyance direction rather than the scanning direction, and each of the grooves 221*a* extends in the scanning direction rather than the conveyance direction. Further, the cam followers 68*c* extending in the conveyance direction are formed in outer side surfaces of the protruding parts 68*b* in the conveyance direction, respectively. When the carriage 11 is moved in the scanning direction toward a maintenance area at which the ink-jet head 12 is maintained by the maintenance unit 7, the carriage 11 presses the pressed portion of the nozzle cap 66 in the scanning direction. Due to pressing force from the carriage 11, the nozzle cap 66 is moved from the uncapping position to the capping position via the intermediate position. When the carriage 11 is moved away from the maintenance unit 7 in the scanning direction, the pressing force from the carriage 11 is weakened and the nozzle cap 66 is moved from the capping position to the uncapping position via the intermediate position by its own weight.

The above description explains the examples in which the present teaching is applied to the printer which performs printing by jetting the ink from nozzles. The present teaching, however, is not limited thereto. The present teaching may be applied, in addition to the printer, to liquid jetting apparatuses jetting, from nozzles, liquid other than the ink.

The embodiment and the modified examples explain the examples in which the present teaching is applied to the ink-jet head 12 which is carried on the carriage 11 and jets the ink from nozzles 17 formed on the lower surface of the ink-jet head 12 while reciprocating in the scanning direction together with the carriage 11. The present teaching, however, is not limited thereto. For example, the present teaching may be applied to a so-called line head including nozzles arranged along the scanning direction.

The embodiment and the modified examples explain the examples in which the cap unit makes contact with the ink jetting surface to cover the nozzles in the capping position. The present teaching, however, is not limited thereto. Provided that the cap unit can cover the nozzles, the cap unit may make contact with other part than the ink jetting surface in the capping position.

What is claimed is:

1. A liquid jetting apparatus, comprising:

a head including nozzles;

a cap configured to cover the nozzles in a state of being in contact with the head unit at a capping position; the cap configured to be apart from the head at an uncapping position, the cap configured to be positioned at an intermediate position at which the cap is apart from the head and is nearer to the head than the uncapping position, wherein the cap comprises a first cap and a second cap, wherein the first cap and the second cap are disposed adjacent to each other, wherein the first cap is configured to cover a first portion of the nozzles and the second cap is configured to cover a second portion of the nozzles;

a pump fluidly connected to the cap;

a motor;

a cam configured to be moved in a first direction by power transmitted from the motor, the cam having a slide surface;

a first gear connected to the motor, wherein the cam is configured to engage with the first gear, and the cam includes a second gear extending in the first direction; and a cam follower provided integrally with the cap, wherein the slide surface includes:

a first inclined surface extending while being inclined by a first angle relative to the first direction and on which the cam follower is positioned under a condition that the cap is positioned between the capping position and the intermediate position; and a second inclined surface extending while being inclined by a second angle being different from the first angle relative to the first direction and on which the cam follower is positioned under a condition that the cap is positioned between the intermediate position and the uncapping position; and a controller configured to:

control the head to perform a flushing process for discharging liquid from the nozzles toward the cap in a state that the cap is positioned at the intermediate position; and control the pump to discharge the liquid accumulated in the cap by the flushing process to outside of the cap in a state that the cap is positioned at the intermediate position.

2. The liquid jetting apparatus according to claim 1, wherein the first angle is smaller than the second angle relative to the first direction.

3. The liquid jetting apparatus according to claim 1, further comprising a cap movement device including the cam, the cam follower, and a support member configured to support the cap from an opposite side of the head, wherein the cap movement device is configured to move the cap between the capping position and the uncapping position via the intermediate position by moving the support member in a cap movement direction intersecting with the first direction.

4. The liquid jetting apparatus according to claim 3, further comprising an elastic member disposed between the cap and the support member and configured to urge the cap toward the head.

5. The liquid jetting apparatus according to claim 3, further comprising a movement support part configured to movably support the support member in the cap movement direction.

6. The liquid jetting apparatus according to claim 1, wherein the slide surface further includes:

a first parallel surface on which the cam follower is positioned under a condition that the cap is positioned at the capping position, the first parallel surface extending in the first direction;

a second parallel surface on which the cam follower is positioned under a condition that the cap is positioned at the intermediate position, the second parallel surface extending in the first direction; and a third parallel surface on which the cam follower is positioned under a condition that the cap is positioned at the uncapping position, the third parallel surface extending in the first direction, the first inclined surface is positioned between the first parallel surface and the second parallel surface, the second inclined surface is positioned between the second parallel surface and the third parallel surface, wherein under a condition that the cam follower is moved from the first parallel surface to the second parallel surface via the first inclined surface, the cap is moved from the capping position to the intermediate position, and wherein under a condition that the cam follower is moved from the second parallel surface to the third parallel surface via the second inclined surface, the cap is moved from the intermediate position to the uncapping position.

7. The liquid jetting apparatus according to claim 6, wherein the head has a nozzle surface in which the nozzles are formed, and a spacing distance between the first parallel surface and the second parallel surface in a third direction which is orthogonal to the nozzle surface is equal to a spacing distance between the second parallel surface and the third parallel surface in the third direction.

8. The liquid jetting apparatus according to claim 1, wherein a length of the second inclined surface in the first direction is shorter than a length of the first inclined surface in the first direction.

9. The liquid jetting apparatus according to claim 1, wherein the cam is configured to be moved in the first direction at a constant speed by the power transmitted from the motor.

10. The liquid jetting apparatus according to claim 1, further comprising a slide support part configured to movably support the cam in the first direction.

11. The liquid jetting apparatus according to claim 1, wherein the first cap communicates through a first tube with a waste liquid tank, and wherein the second cap communicates through a second tube with the waste liquid tank.

12. The liquid jetting apparatus according to claim 1, wherein the controller is further configured to:

control the head to perform a flushing process for discharging liquid from the first portion of the nozzles toward the first cap in a state that the first cap is positioned at the intermediate position; and control the pump to discharge the liquid accumulated in the first cap by the flushing process to outside of the first cap in a state that the first cap is positioned at the intermediate position.

13. The liquid jetting apparatus according to claim 1, wherein the controller is further configured to:

control the head to perform a flushing process for discharging liquid from the second portion of the nozzles toward the second cap in a state that the second cap is positioned at the intermediate position; and control the pump to discharge the liquid accumulated in the second cap by the flushing process to outside of the second cap in a state that the second cap is positioned at the intermediate position.

14. The liquid jetting apparatus according to claim 1, further comprising conveyance rollers configured to convey a sheet in the first direction.

15. The liquid jetting apparatus according to claim 1, wherein the head has a nozzle surface in which the nozzles are formed, and the first cap and the second cap are disposed adjacent to each other in a second direction, which is orthogonal to the first direction and parallel to the nozzle surface.

* * * * *